US007779923B2

(12) United States Patent
Holland et al.

(10) Patent No.: US 7,779,923 B2
(45) Date of Patent: Aug. 24, 2010

(54) METHODS AND APPARATUS FOR ANCHORING AND EXPANDING TUBULAR MEMBERS

(75) Inventors: Mark Holland, Katy, TX (US); Gregory Marshall Noel, Katy, TX (US); Edwin Arnold Zwald, Jr., Houston, TX (US)

(73) Assignee: Enventure Global Technology, LLC, Houston, TX (US)

( * ) Notice: Subject to any disclaimer, the term of this patent is extended or adjusted under 35 U.S.C. 154(b) by 0 days.

(21) Appl. No.: 12/208,498

(22) Filed: Sep. 11, 2008

(65) Prior Publication Data

US 2009/0065196 A1 Mar. 12, 2009

Related U.S. Application Data

(60) Provisional application No. 60/971,282, filed on Sep. 11, 2007, provisional application No. 60/989,587, filed on Nov. 21, 2007.

(51) Int. Cl.
*E21B 23/00* (2006.01)

(52) U.S. Cl. ..... 166/380; 166/378; 166/207

(58) Field of Classification Search ..... 166/207, 166/378, 380

See application file for complete search history.

(56) References Cited

U.S. PATENT DOCUMENTS 6,568,471 B1 5/2003 Cook et al.
6,742,598 B2 * 6/2004 Whitelaw et al. ..... 166/207
6,832,649 B2 * 12/2004 Bode et al. ..... 166/278
7,182,141 B2 * 2/2007 Tran et al. ..... 166/207
7,231,985 B2 6/2007 Cook et al.
7,270,188 B2 9/2007 Cook et al.
7,275,601 B2 10/2007 Cook et al.
7,299,881 B2 11/2007 Cook et al.
7,360,591 B2 * 4/2008 Ring ..... 166/207
7,383,889 B2 6/2008 Ring et al.
2005/0022986 A1 * 2/2005 Ring et al. ..... 166/207
2005/0126251 A1 * 6/2005 Oosterling et al. ..... 72/393
2005/0194128 A1 * 9/2005 Campo ..... 166/207
2006/0052936 A1 * 3/2006 Duggan et al. ..... 702/6
2006/0273584 A1 * 12/2006 McGarian et al. ..... 285/334
2007/0267201 A1 * 11/2007 Brezinski et al. ..... 166/387

* cited by examiner

*Primary Examiner*—William P Neuder
*Assistant Examiner*—Elizabeth C Gottlieb
(74) *Attorney, Agent, or Firm*—Conley Rose, P.C.

(57) ABSTRACT

A method for expanding a tubular member in a wellbore includes applying a downward force to an expansion cone through a work string to anchor the tubular member in the wellbore and pulling upwards on the expansion cone with the work string to expand the tubular member. The expansion cone is disposed in a launcher portion connected to the tubular member being expanded.

14 Claims, 20 Drawing Sheets

METHODS AND APPARATUS FOR ANCHORING AND EXPANDING TUBULAR MEMBERS

CROSS REFERENCE TO RELATED APPLICATIONS

This application claims priority to U.S. Provisional Application Ser. No. 60/971,282 filed Sep. 11, 2007, and U.S. Provisional Application Ser. No. 60/989,587, filed Nov. 21, 2007, the disclosures of which are incorporated herein by reference in their entireties.

BACKGROUND OF THE INVENTION

Conventionally, when a wellbore is created, a number of casings are installed in the borehole to prevent collapse of the borehole wall and to prevent undesired outflow of drilling fluid into the formation or inflow of fluid from the formation into the borehole. The borehole is drilled in intervals whereby a casing which is to be installed in a lower borehole interval is lowered through a previously installed casing of an upper borehole interval. As a consequence of this procedure the casing of the lower interval is of smaller diameter than the casing of the upper interval. Thus, the casings are in a nested arrangement with casing diameters decreasing in downward direction. Cement annuli are provided between the outer surfaces of the casings and the borehole wall to seal the casings from the borehole wall. As a consequence of this nested arrangement a relatively large borehole diameter is required at the upper part of the wellbore. Such a large borehole diameter involves increased costs due to heavy casing handling equipment, large drill bits and increased volumes of drilling fluid and drill cuttings. Moreover, increased drilling rig time is involved due to required cement pumping, cement hardening, required equipment changes due to large variations in hole diameters drilled in the course of the well, and the large volume of cuttings drilled and removed.

To overcome problems with nesting of casing diameters and to patch existing casing, systems and methods have been developed to expand tubulars after being placed into the well. The present disclosure relates to new systems and methods for expanding tubulars in a wellbore.

SUMMARY OF INVENTION

In one aspect, the present disclosure relates to a system for expanding a tubular member in a wellbore. The system includes an expandable tubular member including a launcher portion near a lower end of the expandable tubular member. The launcher portion has a greater inside diameter than other portions of the expandable tubular member. The system further includes an expansion cone disposed in the launcher portion, including an upper expansion surface, and having a greater outside diameter than an inside diameter of a portion of the expandable tubular member above the launcher portion. The system further includes a work string configured to apply a downward force to the expansion cone and an anchoring portion disposed below the launcher portion and configured to anchor the expandable tubular member in the wellbore in response to downward force delivered through the work string.

In another aspect, the present disclosure relates to a method for expanding a tubular member in a wellbore. The method includes applying a downward force to an expansion cone through a work string to anchor the tubular member in the wellbore and pulling upwards on the expansion cone with the work string to expand the tubular member. The expansion cone is disposed in a launcher portion connected to the tubular member being expanded.

Other aspects and advantages of the invention will be apparent from the following description and the appended claims.

DETAILED DESCRIPTION

Methods and apparatus for expanding tubular members in a wellbore are disclosed herein.

Figure 1A:
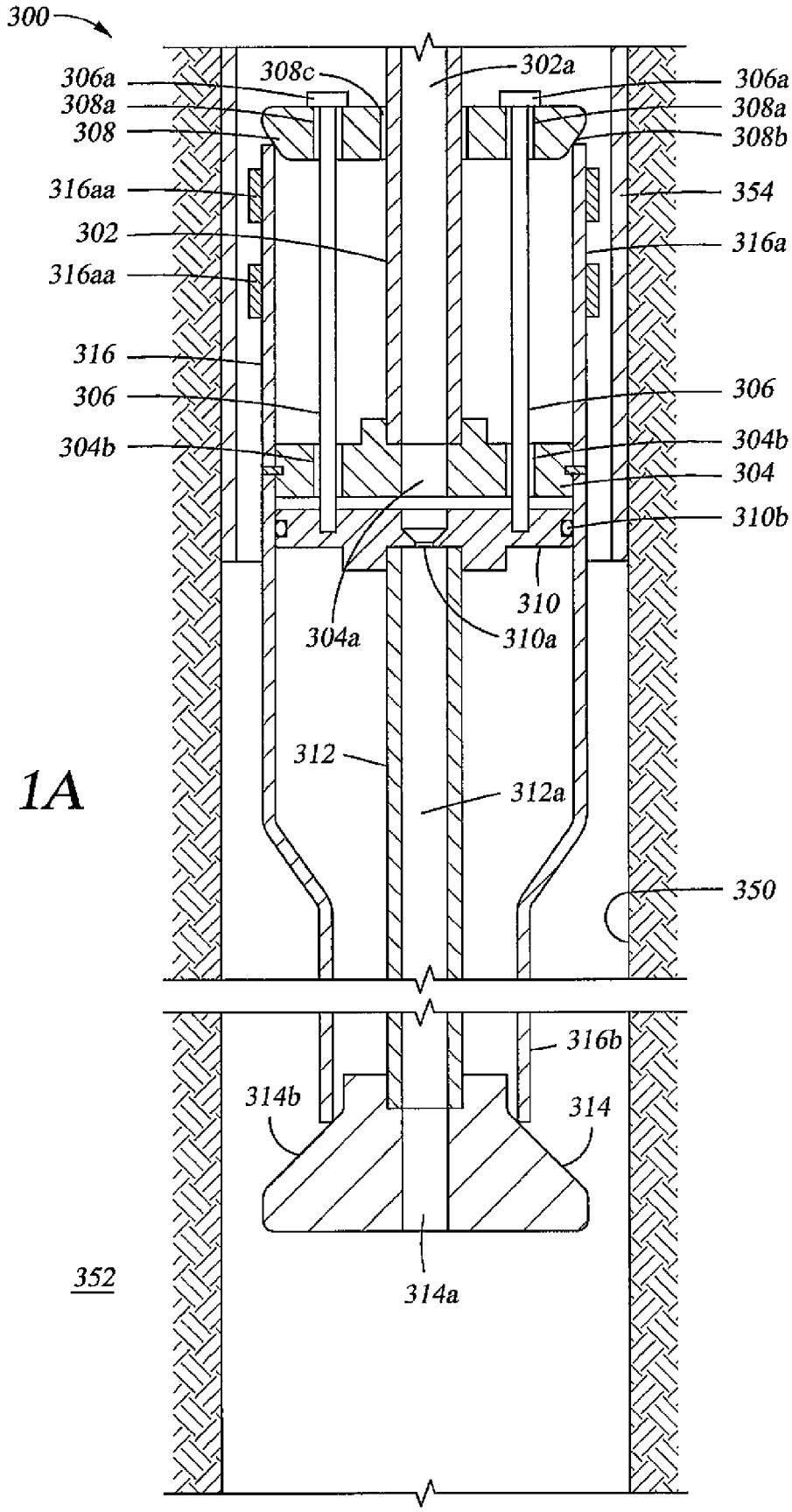
FIG. 1A is a fragmentary cross sectional illustration of an expansion system in accordance with one aspect of the claimed subject matter.

Referring to FIG. 1A, an expansion system 300 includes a tubular support member 302 that defines a passage 302*a* having an end that is coupled to an end of a tubular locking assembly 304 that defines a passage 304*a* that is fluidicly coupled to the passage 302*a* and one or more circumferentially spaced apart guide passages 304*b*. In one embodiment, the tubular locking assembly 304 includes one or more conventional releaseable locking elements for permitting the locking assembly to releasably engage an outer tubular member.

One or more support lugs 306 are received within corresponding guide passages 304*b* that include flanges 306*a* at one end. One end of the lugs 306 extends through corresponding guide passages 308*a* defined within an expansion cone 308 that includes an outer tapered surface 308*b* and defines a passage 308*c* that receives the tubular support member 302. The other ends of the support lugs 306 are coupled to an end of a support member 310 that defines a valveable passage 310*a* and includes an outer sealing member 310*b* for sealingly engaging an outer tubular member.

An end of a tubular support member 312 that defines a passage 312*a* is coupled to another end of the support member 310. In one embodiment, the passage 312*a* is fluidicly coupled to the passage 310*a*. An end of an expansion cone 314 that defines a passage 314*a* and includes an outer tapered surface 314*b* is coupled to the other end of the tubular support member 312.

An upper end 316*a* of an expandable tubular member 316 is releasably coupled to the locking assembly 304 and sealingly engages the sealing element 310*b* of the support member 310 and includes one or more exterior sealing elements 316*aa*. A lower end 316*b* of the tubular member 316 is positioned proximate the tapered external surface 314*b* of the expansion cone 314. In one embodiment, the inside diameter of the upper portion 316*a* of the tubular member 316 is greater than the inside diameter of the lower portion 316*b* of the tubular member.

In one embodiment, during the operation of the expansion system 300, as illustrated in FIG. 1A, the expansion system is positioned within a wellbore 350 that traverses a subterranean formation 352. In one embodiment, the wellbore 350 includes a preexisting wellbore casing 354.

Figure 1B:
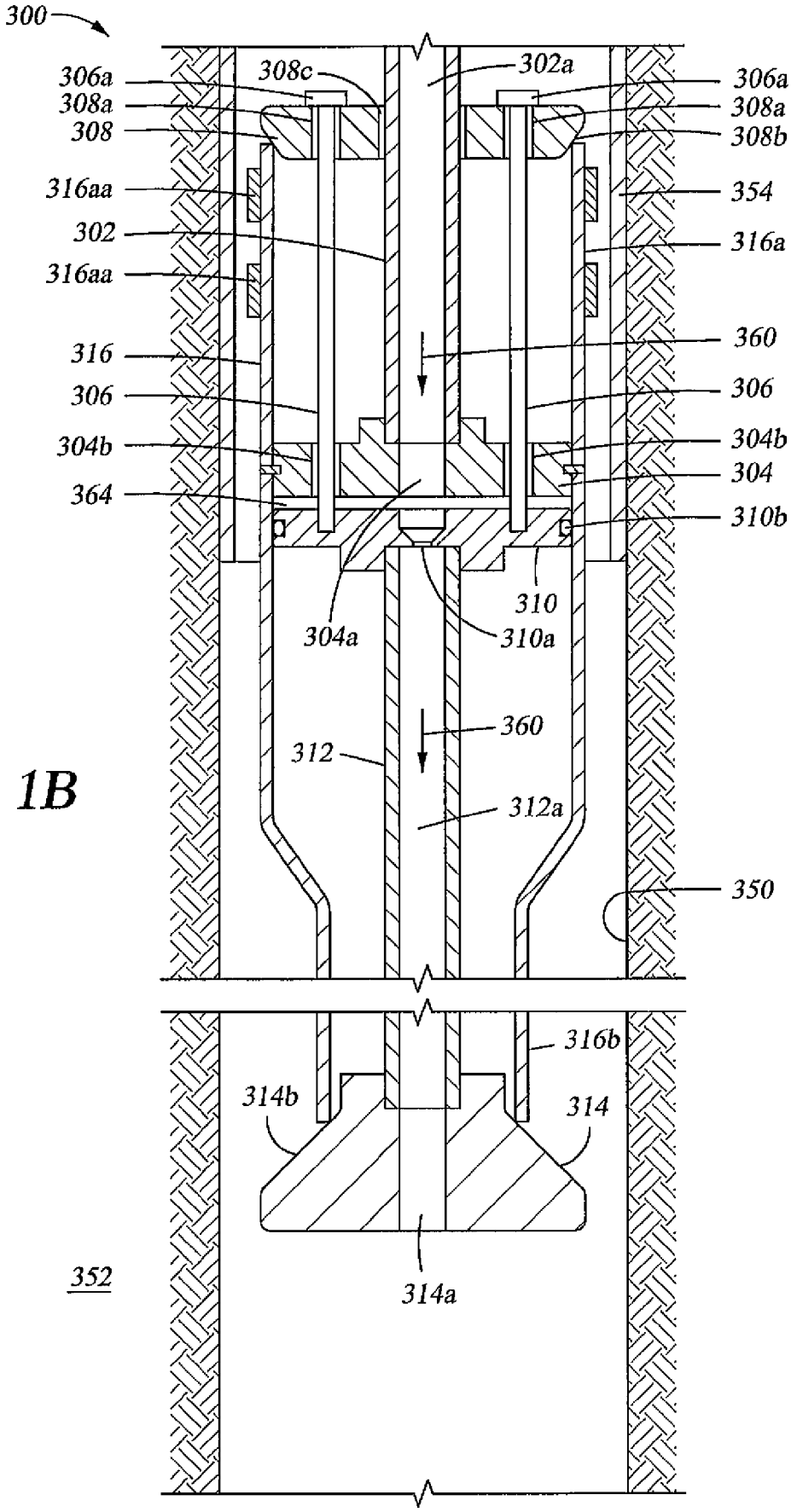
FIG. 1B is an illustration of the expansion system of FIG. 1A during the injection of fluidic material into the system.

In one embodiment, as illustrated in FIG. 1B, a fluidic material 360 is then injected into and through the expansion system 300 in order to ensure the proper functioning of the associated fluid passages.

Figure 1C:
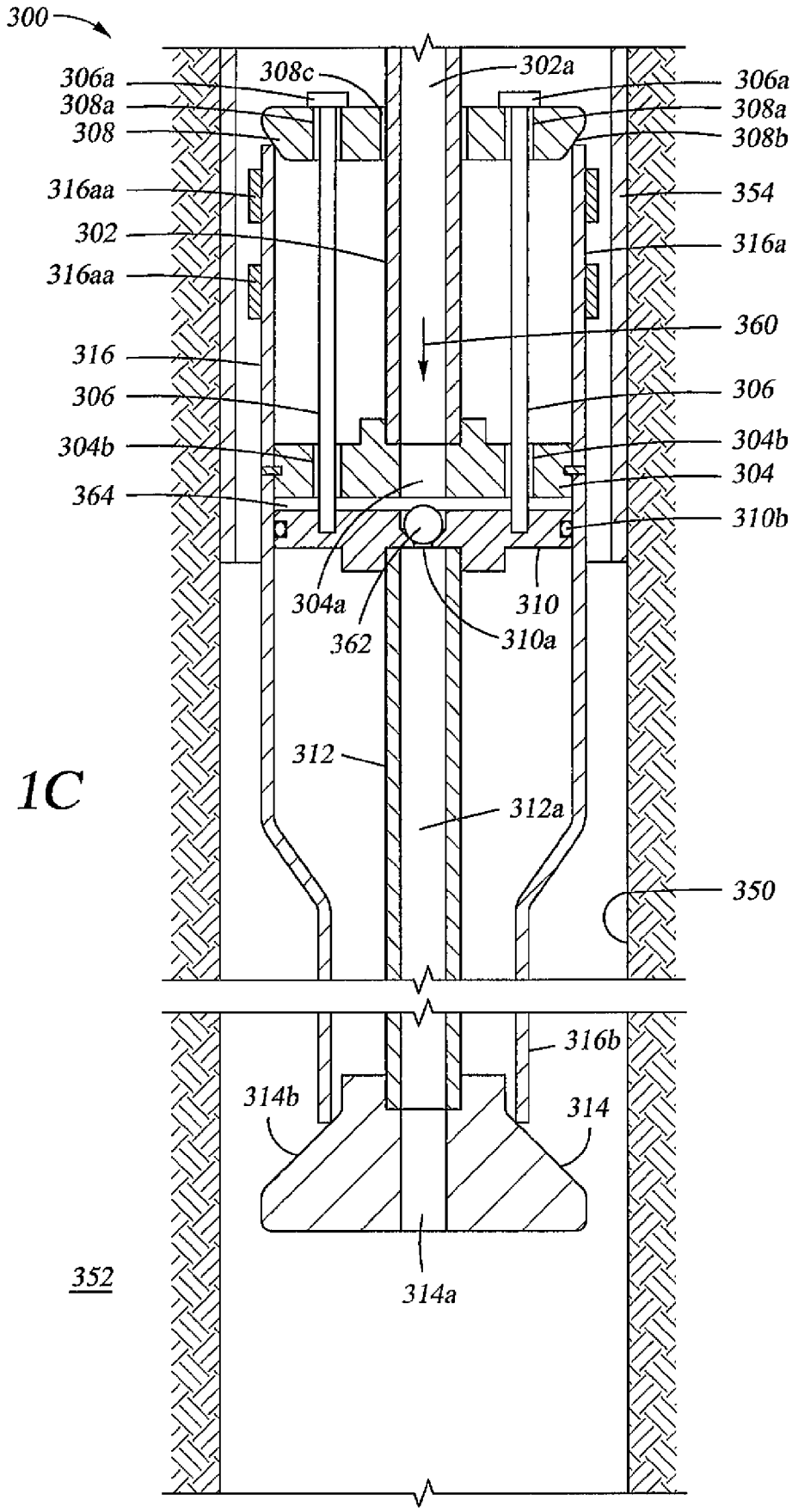
FIG. 1C is an illustration of the expansion system of FIG. 1B during the injection of a ball into the system.

In one embodiment, as illustrated in FIG. 1C, a ball 362, or similar device, is then injected into the expansion system 300 and the ball then is positioned within the valveable passage 310*a* of the support member 310 thereby sealing off the valveable passage and defining a pressure chamber 364 within the upper portion 316*a* of the tubular member 316 between the locking assembly 304 and the support member 310.

Figure 1D:
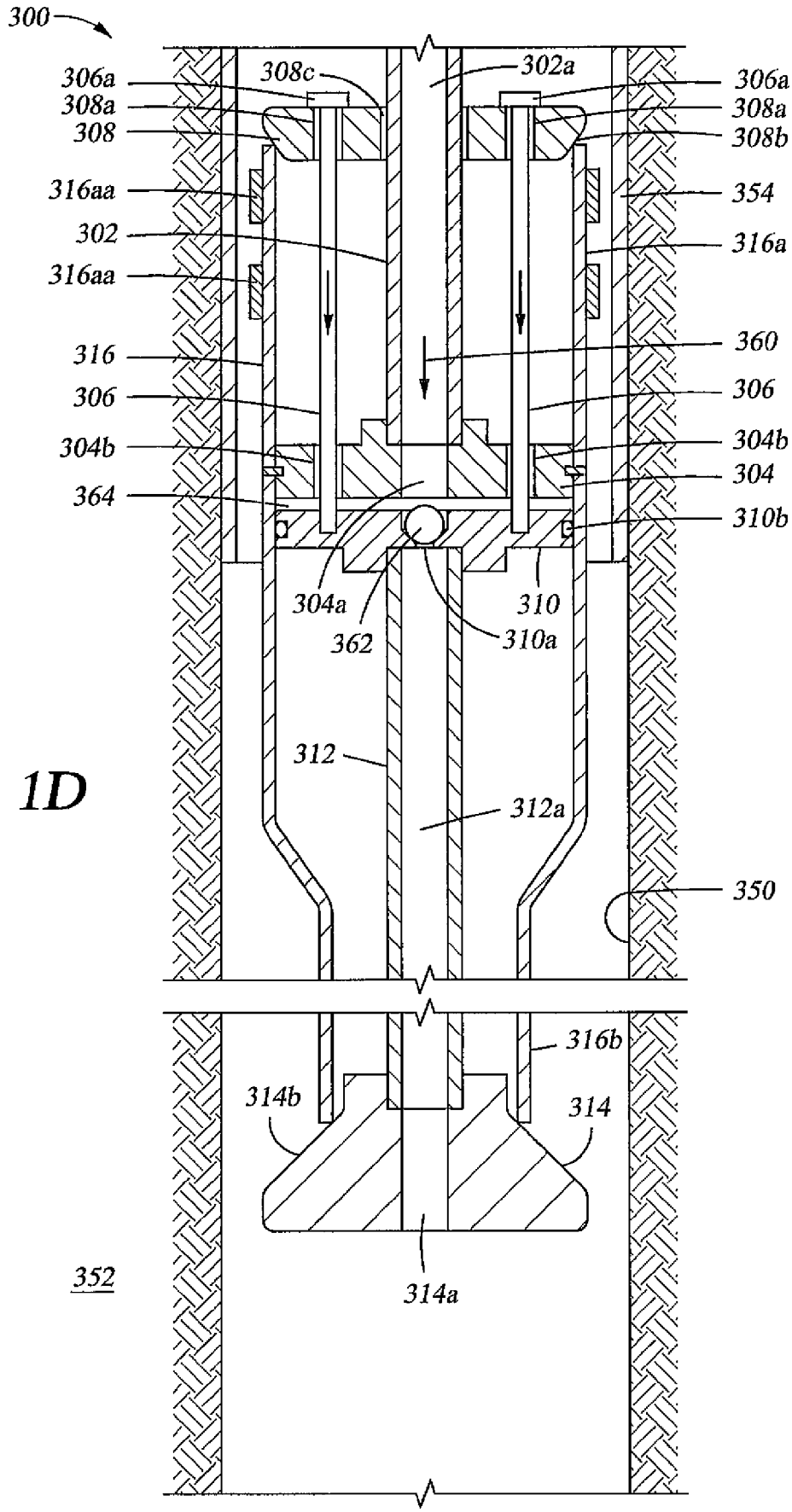
FIG. 1D is an illustration of the expansion system of FIG. 1C during the pressurization of a pressure chamber to thereby radially expand and plastically deform an upper portion of a tubular member.

In one embodiment, as illustrated in FIG. 1D, continued injection of the fluidic material 360 further pressurizes the chamber 364 thereby causing the lugs 306 and the support member 310 to be displaced downwardly relative to the locking assembly 304 and the tubular member 316. As the flanges 306*a* of the lugs 306 engage the upper end of the expansion cone 308, the expansion cone is also displaced downwardly relative to the tubular member 316.

Figure 1E:
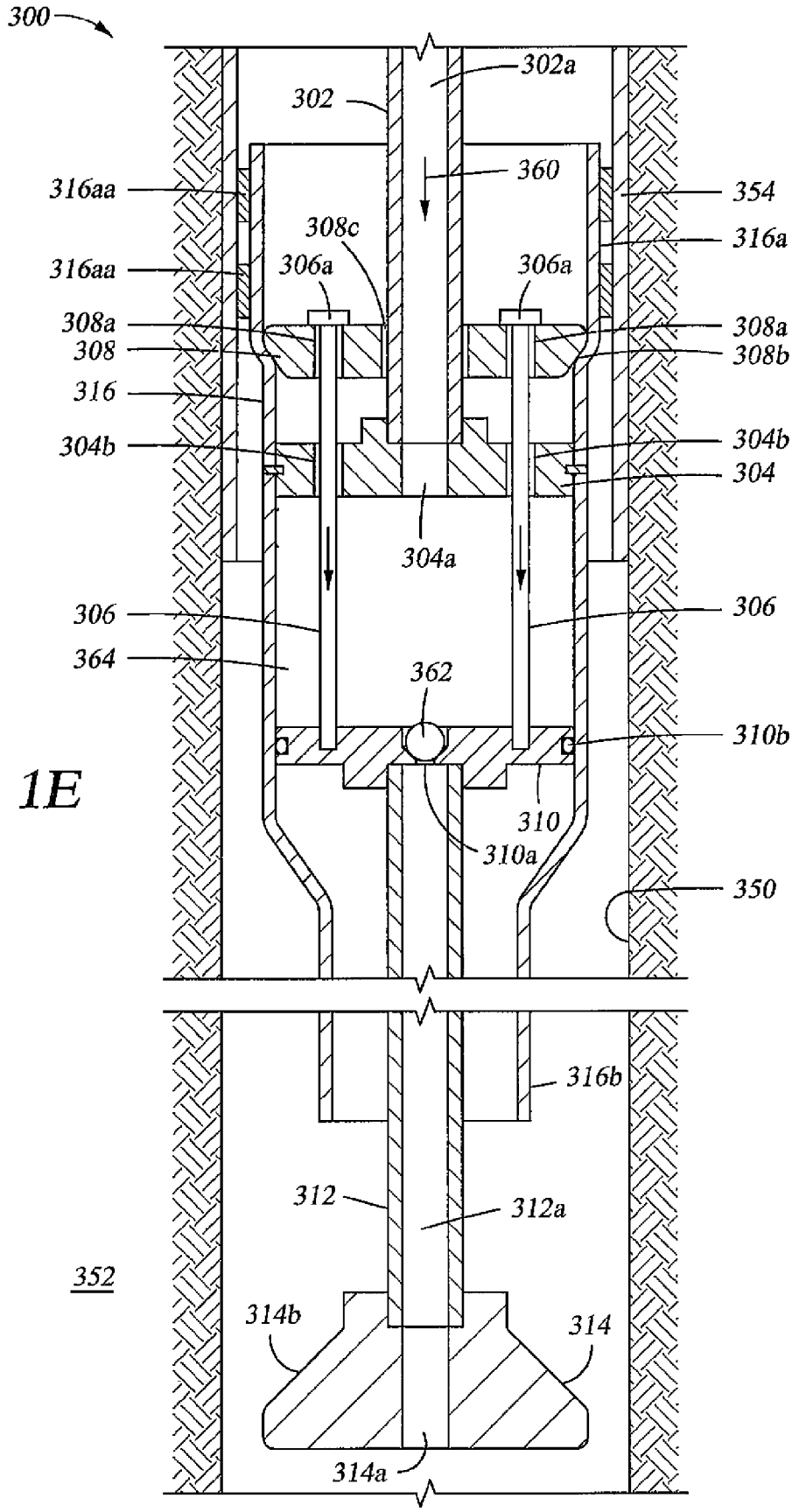
FIGS. 1E and 1F are illustrations of the expansion system of FIG. 1D during the continued pressurization of the pressure chamber to thereby further radially expand and plastically deform the upper portion of the tubular member.

In one embodiment, as illustrated in FIG. 1E, the continued injection of the fluidic material 360 further pressurizes the chamber 364 and further displaces the expansion cone 308 downwardly relative to the tubular member 316. As a result, at least a portion of the upper portion 316*a* of the tubular member 316 is radially expanded and plastically deformed. In one embodiment, the upper portion 316*a* of the tubular member 316 is radially expanded and plastically deformed into engagement with the preexisting wellbore casing 354.

Figure 1F:
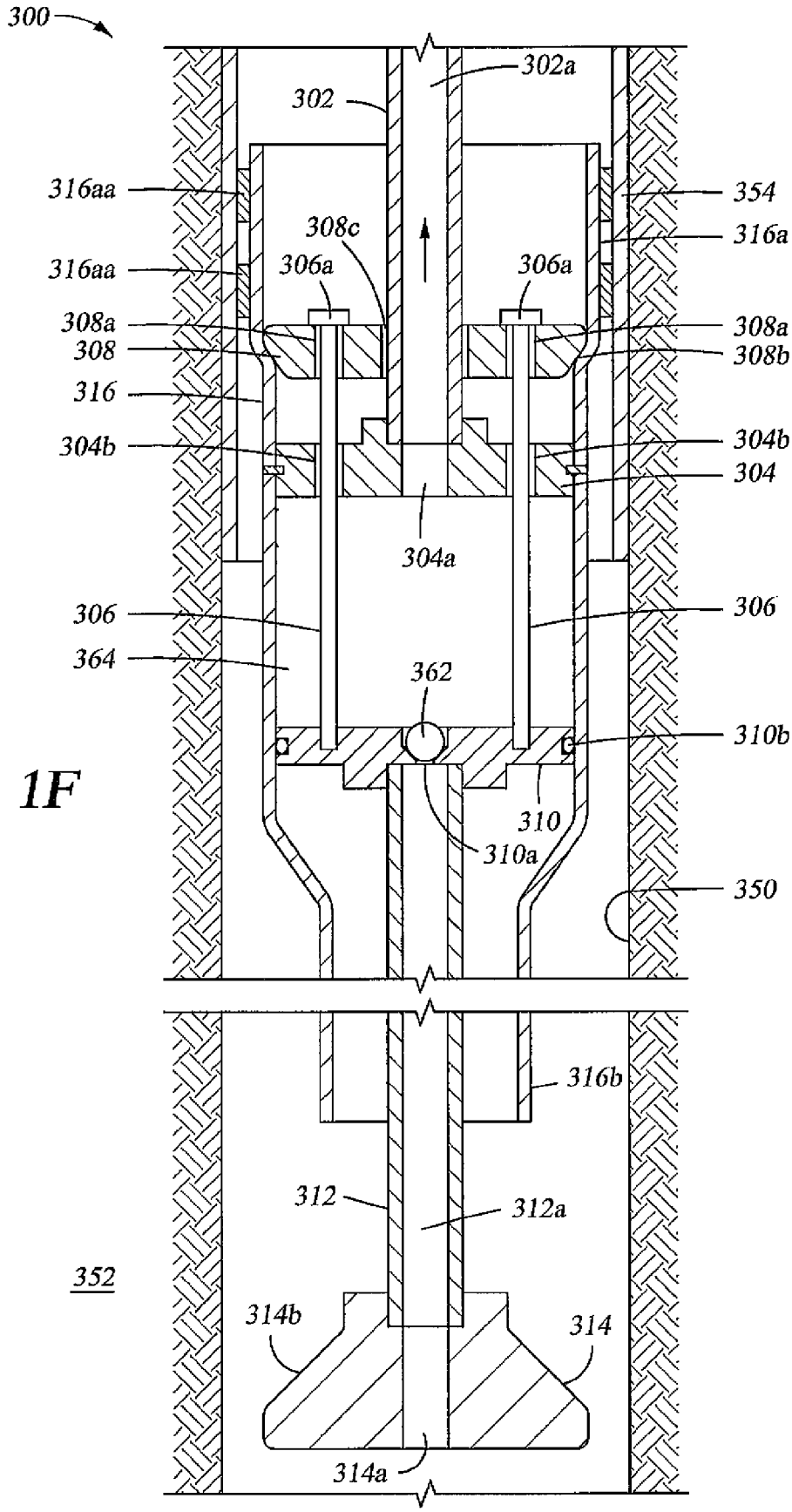

In one embodiment, as illustrated in FIG. 1F, the injection of the fluidic material 360 is stopped and an upward tensile force is applied to the tubular support member 302. In one embodiment, as a result, the locking assembly 304 is disengaged from the upper portion 316*a* of the tubular member 316.

Figure 1G:
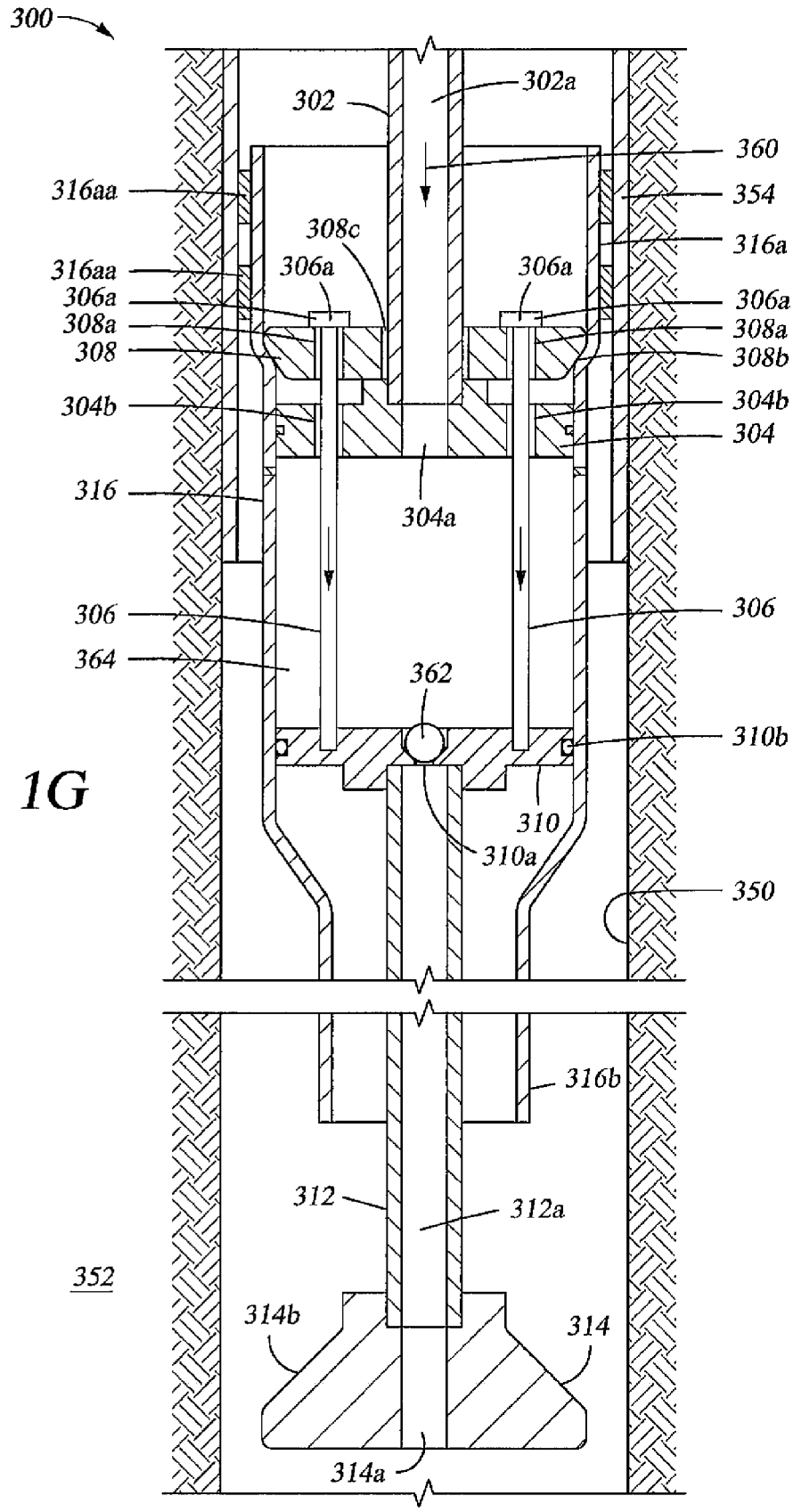
FIG. 1G is an illustration of the expansion system of FIG. 1F upon lifting the tubular support member.

In one embodiment, as illustrated in FIG. 1G, the continued application of an upward tensile force to the tubular support member 302 causes the locking assembly 304 to be displaced further upwardly thereby contacting the end of the expansion cone 308. As a result, the expansion cone 308 is displaced upwardly until the other end of the expansion cone contacts and engages the flanges 306*a* of the lugs 306. As a result, the lugs 306, the support member 310, tubular support member 312 and the expansion cone 314 are displaced upwardly relative to the tubular member 316.

Figure 1H:
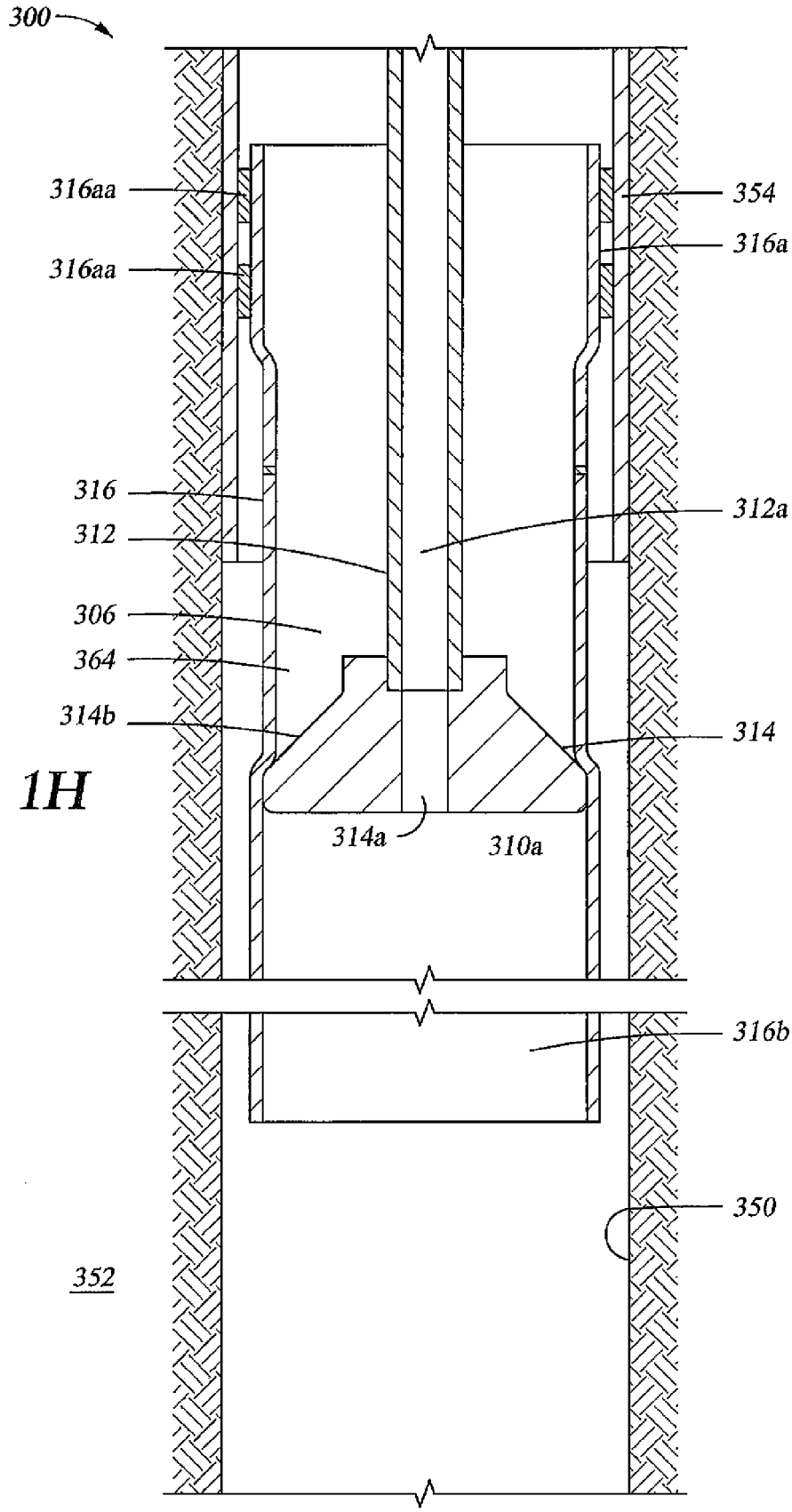
FIG. 1H is an illustration of the expansion system of FIG. 1G upon further lifting the tubular support member.

In one embodiment, as illustrated in FIG. 1H, the continued application of an upward tensile force to the tubular support member 302 causes the expansion cone 314 to be further displaced upwardly relative to the tubular member 316. As a result, at least a portion of the tubular member 316 is radially expanded and plastically deformed by the expansion cone 314.

Figure 1I:
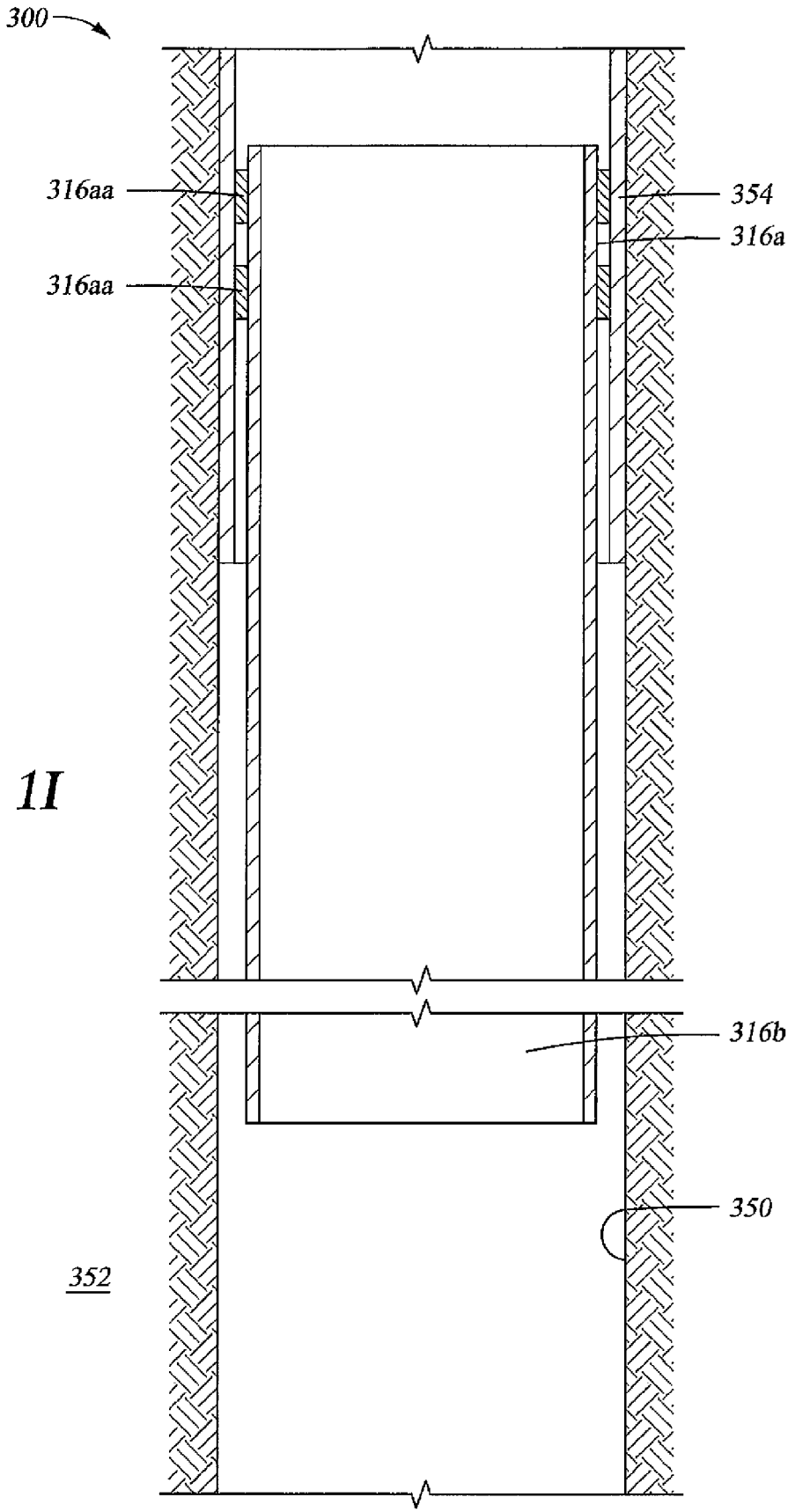
FIG. 1I is an illustration of the expansion system of FIG. 1H upon further lifting the tubular support member to thereby radially expand and plastically deform a lower portion of the tubular member.

In one embodiment, as illustrated in FIG. 1I, the continued application of an upward tensile force to the tubular support member 302 causes the expansion cone 314 to be further displaced upwardly relative to the tubular member 316. As a result, the remaining portion of the tubular member 316 is radially expanded and plastically deformed by the expansion cone 314.

In several exemplary embodiments, one or more of the expansion devices 308 and 314, described above may include one or more adjustable expansion devices and/or combinations of adjustable and/or non-adjustable expansion devices.

In one embodiment, one of the expansion devices 308 and 314, described above may include one or more rotary expansion devices and/or combinations of rotary and/or non-rotary expansion devices.

In one embodiment, one of the expansion devices 308 and 314, described above may include one or more hydroforming expansion devices and/or combinations of hydroforming and/or non-hydroforming expansion devices.

Referring now to FIGS. 2A, 2B, 3A, 3B, 4A, 4B, 4C, 5A, and 5B, various embodiments of anchor devices are provided for use according to the methods described herein. Specifically, the anchor devices described allow for ease of use, as well as an inexpensive alternative to other known means for anchoring tubular members to a preexisting structure in a wellbore.

Figure 2A:
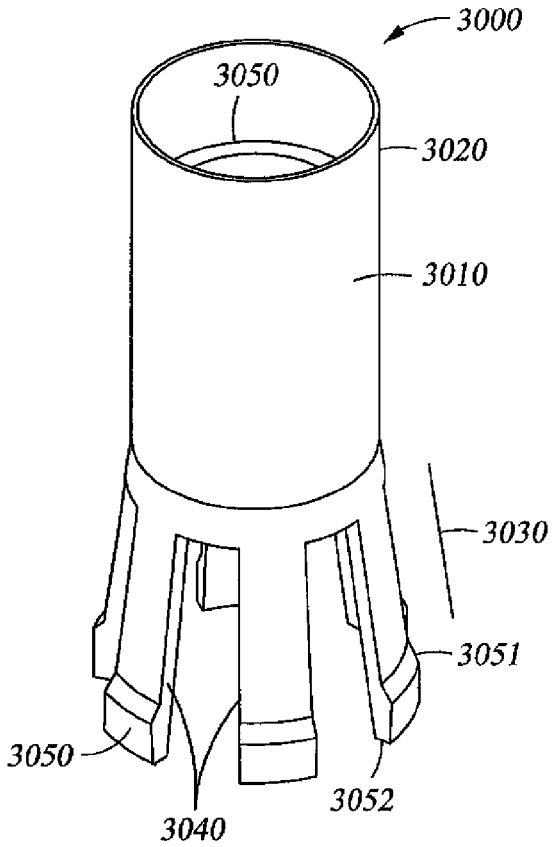
FIG. 2A is an illustration of a latching device in accordance with one aspect of the claimed subject matter.
Figure 3A:
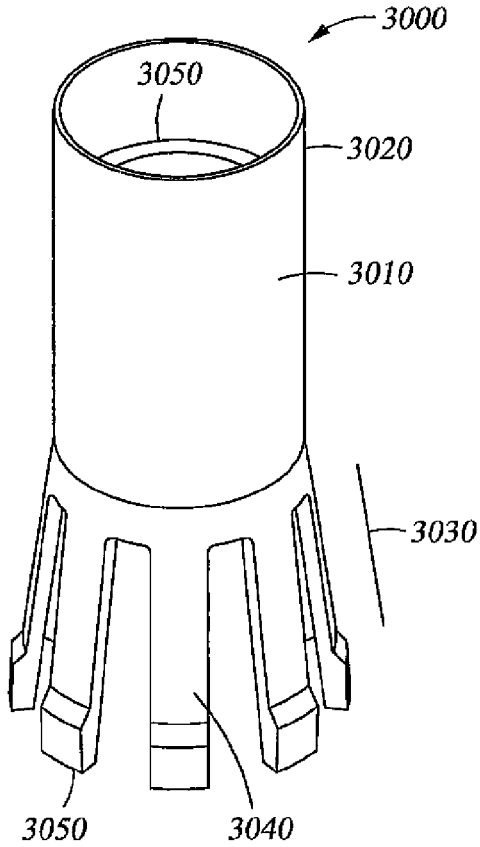
FIG. 3A is an illustration of a latching device in accordance with one aspect of the claimed subject matter.

In one embodiment, as illustrated in FIGS. 2A and 3A, the anchoring device 3000 may include a tubular body 3010 having a first end 3020 and a second end 3030. The tubular body 3010 may have a substantially constant outer diameter. The first end 3010 of the anchoring device 3000 may include a means for releasably coupling the device to a tubular member, including, but not limited to, a threaded coupling or a latch. The second end 3030 of the tubular body 3010 may include a plurality of latching or latching members 3040 which extend outward. The latching members 3040 may be outwardly biased and may extend outward from a plane extending from the tubular body 3010 at an angle greater than 10°. The latching members 3040 may also include a boss or ridge 3050 extending from the ends of the latching members 3040. The boss 3050 can be adapted for attachment to an existing structure, including but not limited to, a recess in a tubular member or casing, or to the upper or lower surface of a tubular member or a casing. The boss 3050 may have different angles on opposing ends: an engagement side 3051 with a shallower angle to facilitate initial latching and a latching side 3052 with a steeper angle to prevent unlatching during expansion. The engagement side 3051 may have, for example, an angle of about 45 degrees or less with respect to the central axis of the anchoring device 3000. In one embodiment, the engagement side 3051 may have an angle of about 30 to about 35 degrees with respect to the central axis of the anchoring device 3000. The latching side 3052 may have, for example, an angle of between about 60 and about 90 degrees with respect to the central axis of the anchoring device 3000. Those having ordinary skill in the art will appreciate that the angles of the engagement side may vary due to other characteristics of the anchoring device, such as the flexibility of the latching members 3040. For example, a steeper angle may be used for the engagement side 3051 if the latching members 3040 are made to be more flexible and that a shallower angle may be more suitable if the latching members 3040 are made to be more rigid.

In other embodiments, the anchoring device 3000 may include cutting means attached to a surface of the latching member 3040. The cutting means can be adapted for creating a channel or recess in a preexisting structure, such as for example, a tubular member or casing, thereby allowing for the anchoring device 3000 to be coupled to the casing or tubular member. The cutting means can include any known means in the art, such as for example, but not limited to, tungsten carbide inserts or diamond tipped inserts.

Figure 2B:
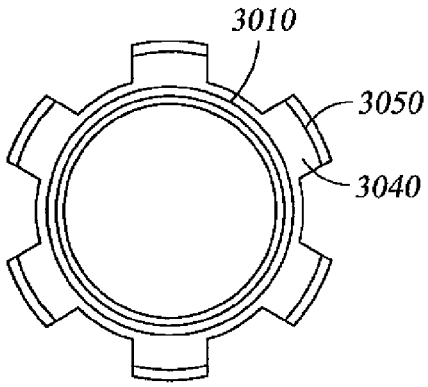
FIG. 2B is top view of the device of FIG. 2A.
Figure 3B:
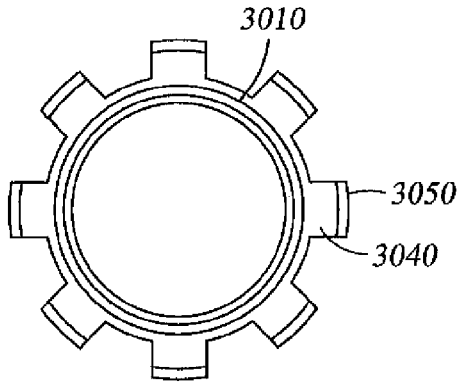
FIG. 3B is top view of the device of FIG. 3A.

As illustrated in FIGS. 2B and 3B, the anchoring device may include a plurality anchoring or latching members 3040. For example, as illustrated in FIG. 2B, the anchoring device 3000 may include six equally spaced latching members 3040, each spaced at 60° intervals from the adjacent latching member. As illustrated in FIG. 3B, in another exemplary embodiment, the anchoring device 3000 may include eight equally spaced latching members, each spaced at 45° intervals from the adjacent latching member. Although FIGS. 2B and 3B illustrate two exemplary embodiments having six and eight equally spaced latching members 3040, it is understood that the number of latching members 3040 may vary. Furthermore, while the exemplary embodiments illustrate latching members 3040 having a substantially equal width and a substantially equal spacing from adjacent members, it is understood that the width and spacing of the latching members 3040 may be varied.

Figure 4A:
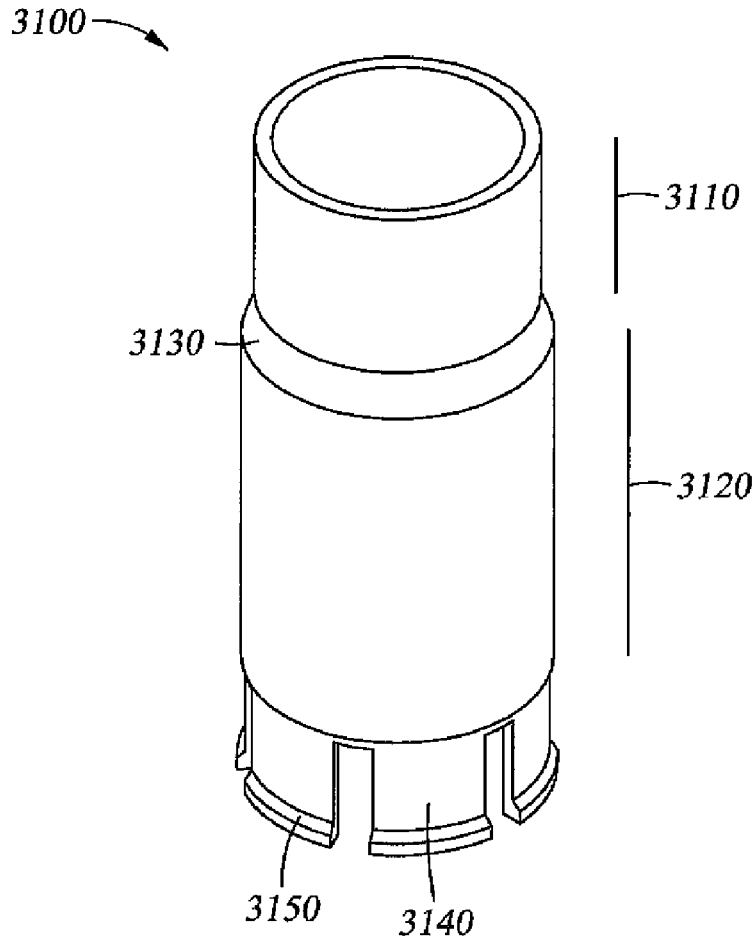
FIG. 4A is an illustration of a latching device in accordance with one aspect of the claimed subject matter.
Figure 4B:
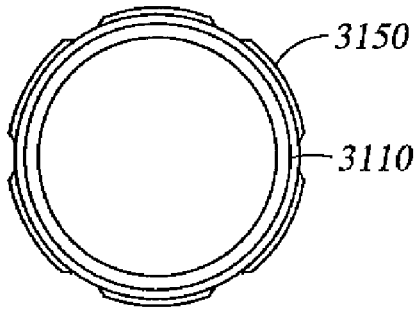
FIG. 4B is a top view of the device of FIG. 4A.
Figure 4C:
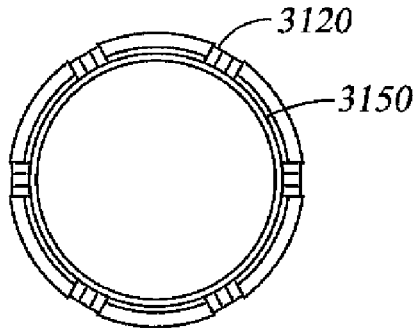
FIG. 4C is a bottom view of the device of FIG. 4A.

FIGS. 4A, 4B, and 4C illustrate another embodiment of an anchoring device 3100 which includes a tubular body having a first end 3110 and a second end 3120. The outer diameter of the first end 3110 is smaller than the outer diameter of second end 3120, resulting in a shoulder 3130 which extends away and outward from the first end 3110. The anchor device 3100 may include a plurality of anchoring or latching members 3140 appended to the second end 3120. As described with respect to FIGS. 2A, 2B, 3A and 3B, the latching members 3140 can be outwardly biased and may include a boss or ridge 3150 to facilitate attachment of the anchoring device 3100 to a preexisting structure. The first end 3110 may include attachment means, such as for example, a latch or threaded coupling. In certain exemplary embodiments, the anchoring device 3100 may be adapted to attach to the pre-existing structure upon expansion with an expansion device.

Figure 5A:
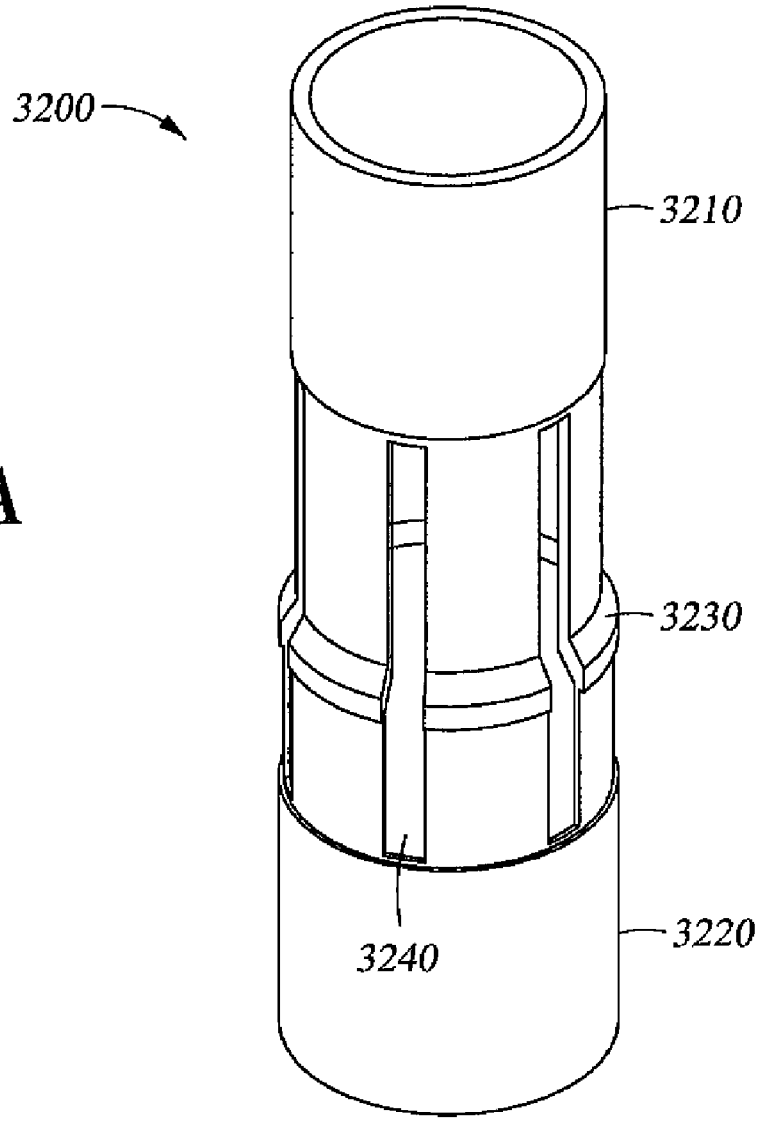
FIG. 5A is an illustration of a latching device in accordance with one aspect of the claimed subject matter.
Figure 5B:
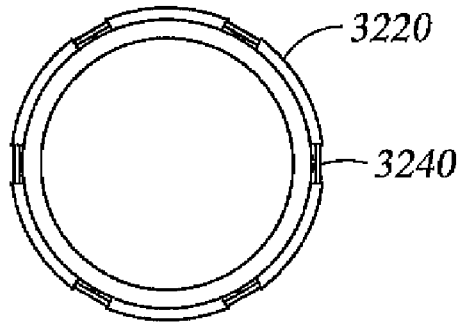
FIG. 5B is a top view of the device of FIG. 5A.
Figure 6A:
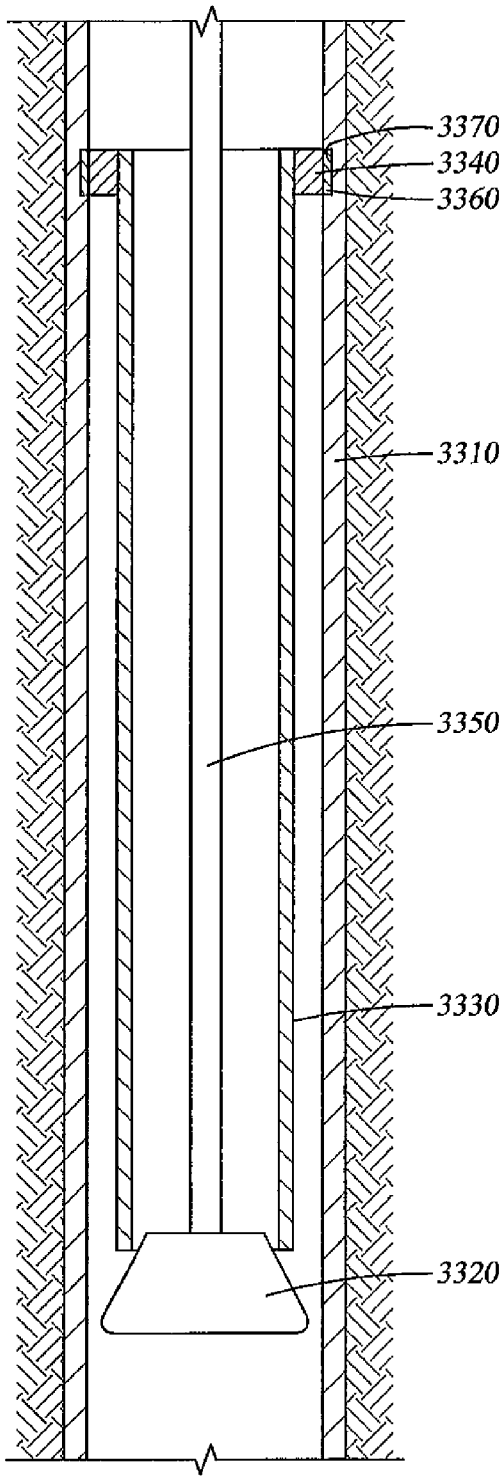
FIG. 6A is an illustration of the anchoring of a tubular member in a borehole.
Figure 6B:
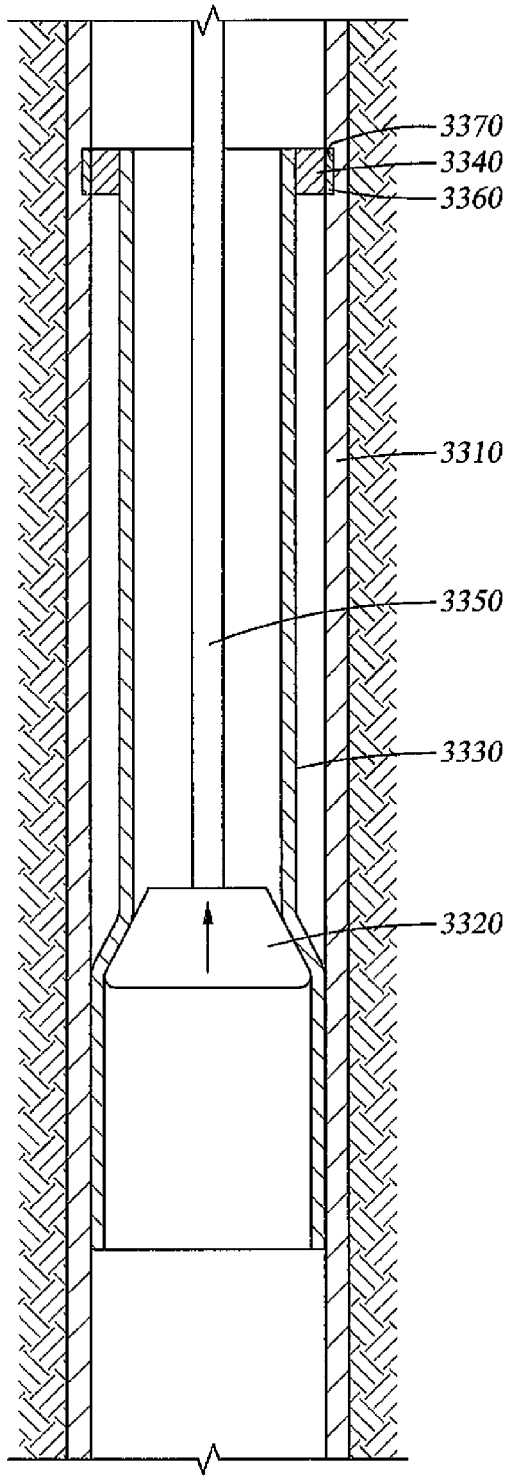
FIG. 6B is an illustration of the preparation for expanding a tubular member anchored in a borehole.
Figure 6C:
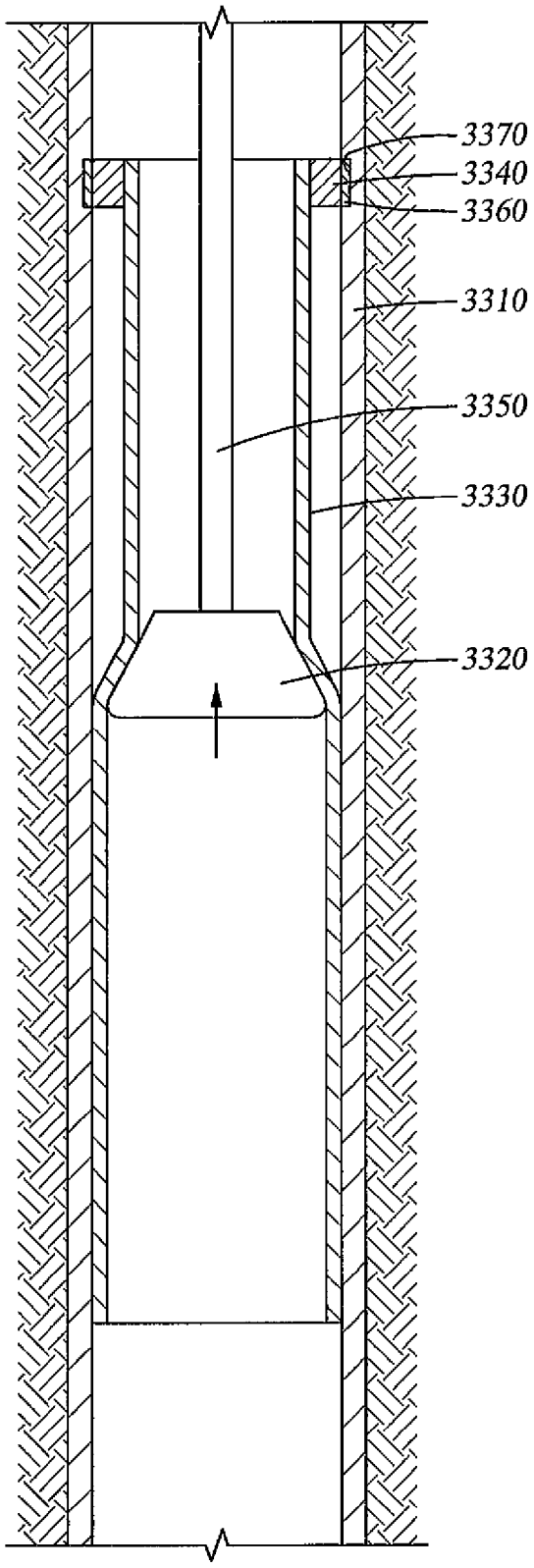
FIG. 6C is an illustration of the expansion of an anchored tubular member.
Figure 6D:
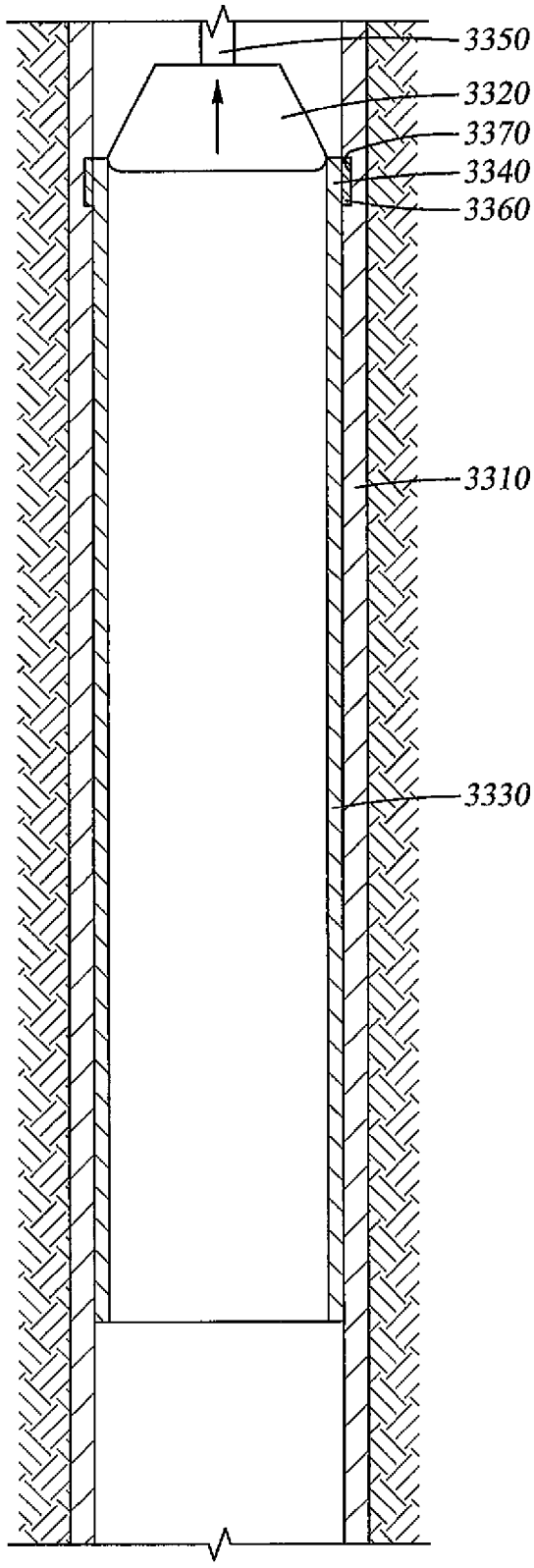
FIG. 6D is an illustration of the completed expansion of an anchored tubular member.

FIGS. 5A and 5B illustrate another embodiment of an anchoring device 3200 which includes a tubular body having a first end 3210 and a second end 3220, wherein the outer diameter of the first end 3210 is smaller than the outer diameter of the second end 3220. A shoulder 3230 is formed at the transition between the first end 3210 and the second end 3220 of the anchoring device 3200. The device 3200 may include a plurality of circumferentially spaced channels 3240 which run along the length of the tubular body of the anchoring device 3200.

During usage, the anchoring devices described herein may be positioned at a variety of locations relative to the expandable tubular members which are being secured, e.g., above the tubular member or below the tubular member.

FIGS. 6A, 6B, 6C and 6D illustrate one use of an anchoring device according to FIG. 2A, 2B, 3A, or 3B, wherein the anchoring device 3340 is positioned at the top of an expandable tubular member 3330 to secure it to a preexisting structure or borehole 3310 for expansion thereof. The anchoring device 3340 may be connected to the expandable tubular member 3330 by any known means, such as for example, a threaded connection. A work string 3350, as well as an expansion device 3320, an expandable tubular member 3330 and an anchoring device 3340 are lowered into a borehole 3310. As described previously, the anchor device 3340 may include a plurality of anchor members 3370 which are outwardly biased and are adapted to engage a recess 3360 in the casing 3310 and secure the expandable tubular member 3330. The anchoring device 3340 may be oriented such that the anchor members 3370 release from a compressed state, extend outward and contact the inside of the casing. As the work string 3350, expansion device 3320, anchoring device 3340 and expandable tubular member 3330 are lowered into the borehole, the anchor members 3370 of the anchoring device 3340 contact the interior of the borehole 3310 and are compressed. When the recess 3360 is reached, the anchor members 3370 extend outward and engage the recess 3360, thus securing the tubular member 3330.

Once the work string 3350 is secured within the borehole 3310 by the anchor members 3370 contacting and securing to a recess 3360, the expansion device 3320 may be pulled up through the expandable tubular member 3330. The expansion device 3320 may be pulled through both the expandable tubular member 3330 and the anchoring device 3340. Following expansion of the tubular member 3330, the work string 3350 and expansion device 3320 may be removed from the borehole 3310.

Referring now to FIGS. 7A, 7B, 7C, and 7D, a multiple trip mechanical expansion system employing an anchoring device 3640 is provided. A work string 3630, an expansion cone 3660, a latch 3650, an expandable tubular member 3620 and an anchoring device 3640 are lowered into a wellbore 3610. As illustrated in FIGS. 7A, 7B, 7C, and 7D, the expansion device 3660 is an expansion cone, but it is understood that any expansion device capable of radial expansion and plastic deformation of the expandable tubular member 3620 may be employed. The work string 3630 is lowered to the desired depth and the expandable tubular member 3620 is secured to the wellbore 3610 with a packer 3670.

Figure 7A:
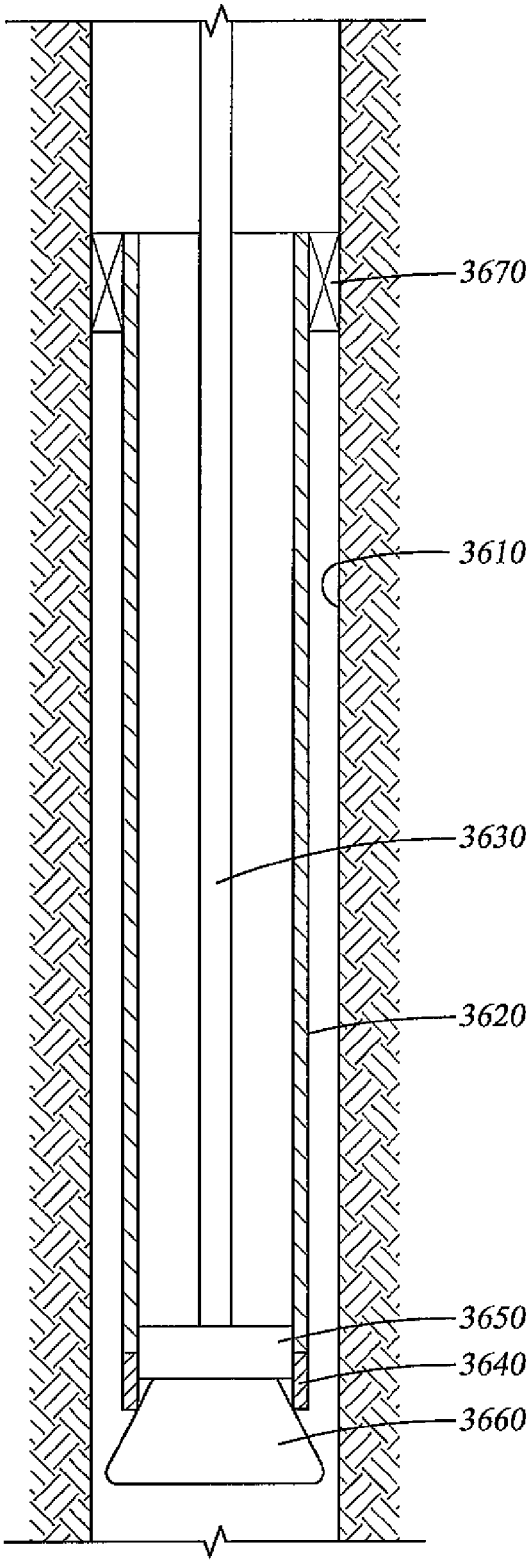
FIG. 7A is a schematic illustration of a system for anchoring a tubular member to a wellbore casing in accordance with one aspect of the claimed subject matter.
Figure 7B:
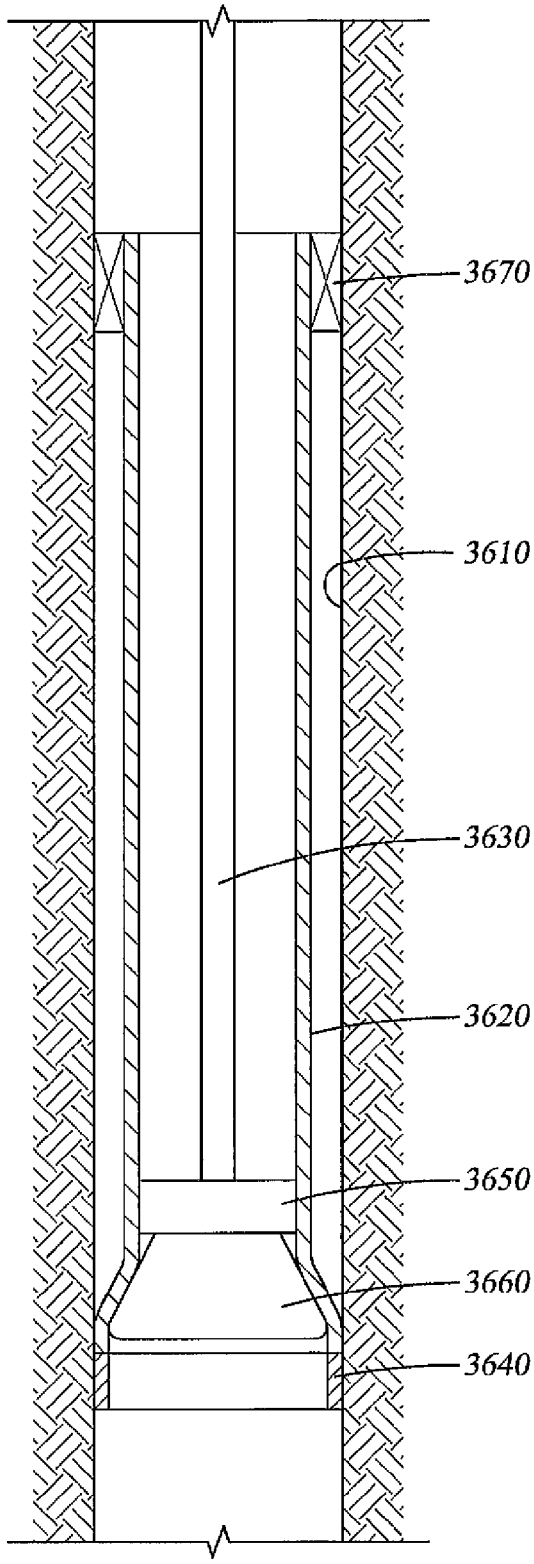
FIG. 7B is a schematic illustration of a system for anchoring a tubular member to a wellbore casing wherein the anchor couples to the bottom of the tubular member in accordance with one aspect of the claimed subject matter.
Figure 7C:
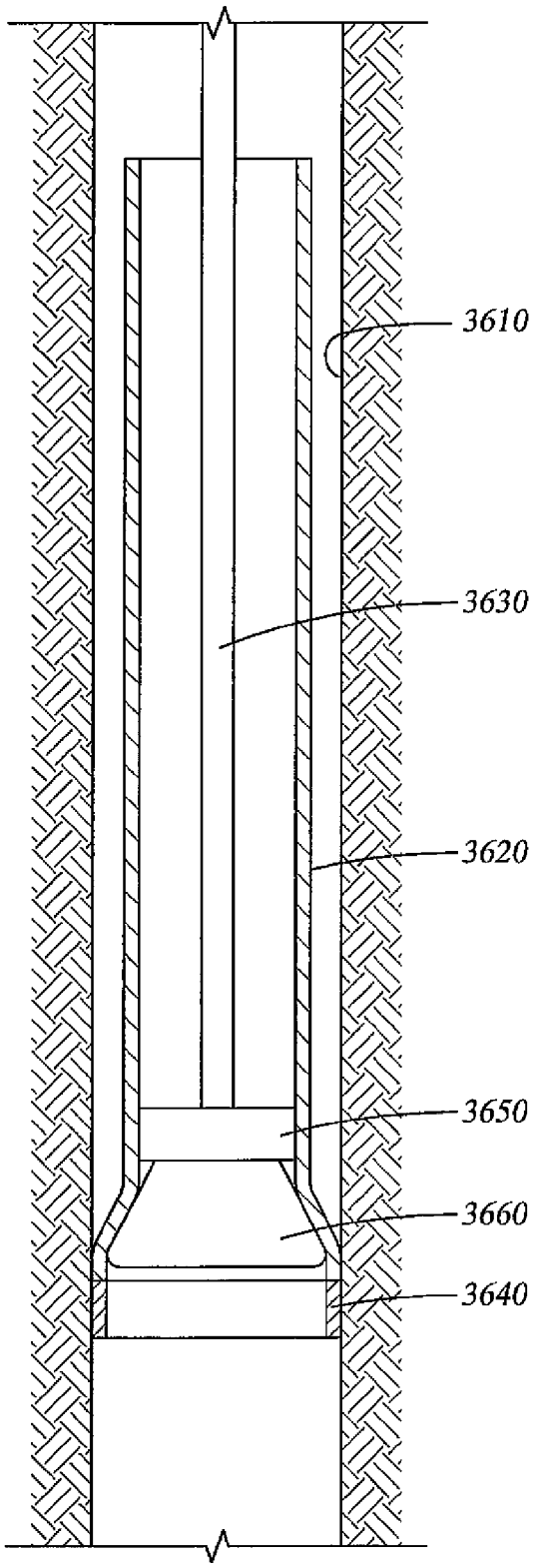
FIG. 7C is a schematic illustration of a system for anchoring a tubular member to a wellbore casing wherein the anchor couples to the bottom of the tubular member in accordance with one aspect of the claimed subject matter.

As illustrated in FIG. 7B, the expansion cone 3660 is pulled up, contacting the anchoring device 3640 and the tubular member 3620, causing the anchor device 3640 to set in the wellbore 3610. Once the tubular member 3620 is secured in the wellbore 3610, the packer 3670 may be removed as illustrated in FIG. 7C.

Figure 7D:
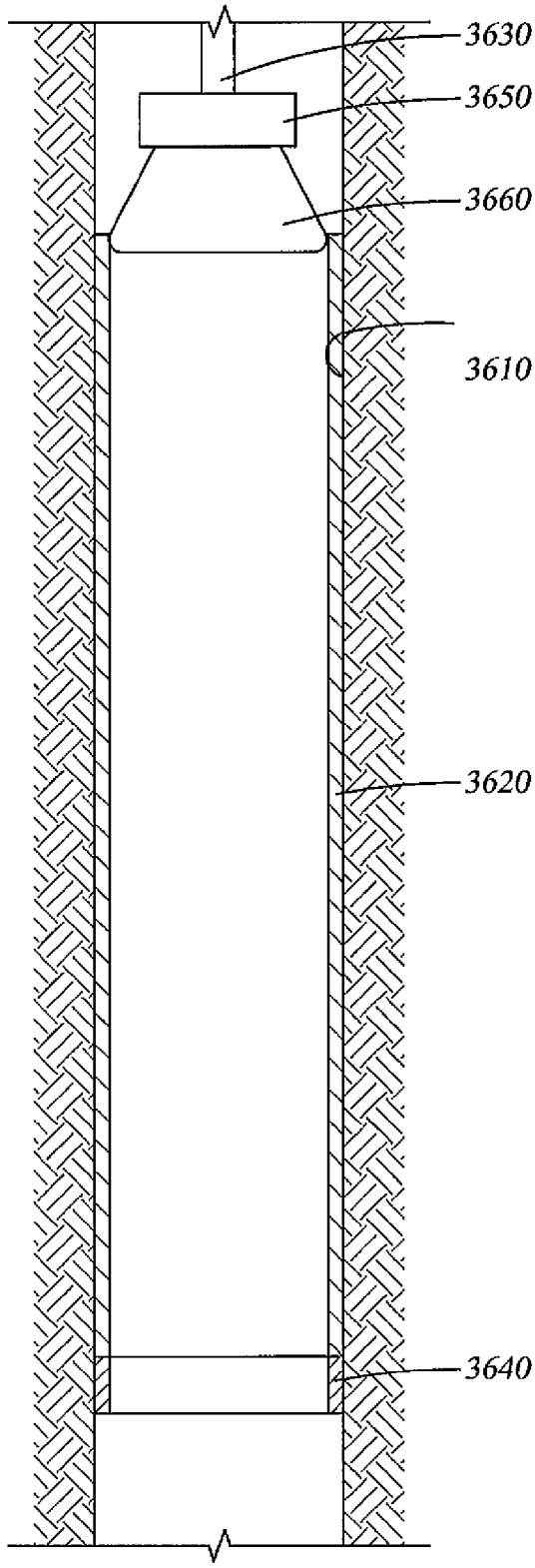
FIG. 7D is a schematic illustration of a system for anchoring a tubular member following completion of the radial expansion of the tubular member in accordance with one aspect of the claimed subject matter.

As illustrated in FIG. 7D, once the packer 3670 is removed, the expansion cone 3660 may be pulled through the remainder of the expandable tubular member 3620, thereby expanding the tubular member 3620 in the wellbore 3610. Following expansion of the tubular member 3620, the expansion cone may be removed from the wellbore 3610.

Figure 8A:
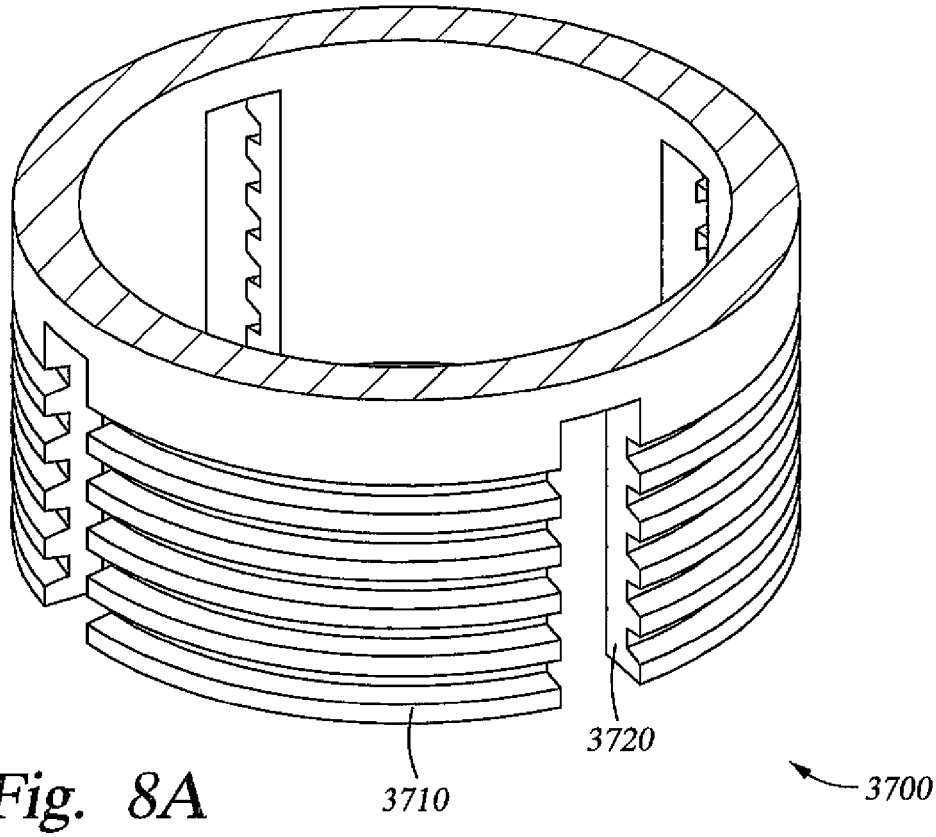
FIG. 8A is a cross sectional illustration of a machined threaded connection in accordance with one aspect of the claimed subject matter.
Figure 8B:
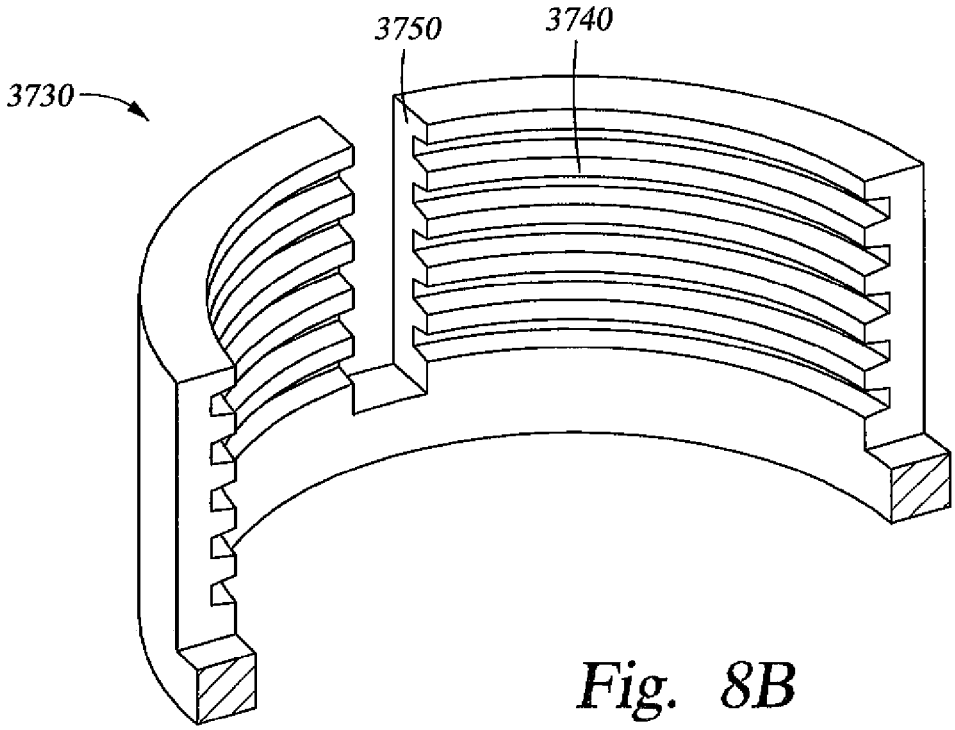
FIG. 8B is a cross sectional illustration of the connection of the male connector of FIG. 9A and a female connector.
Figure 8C:
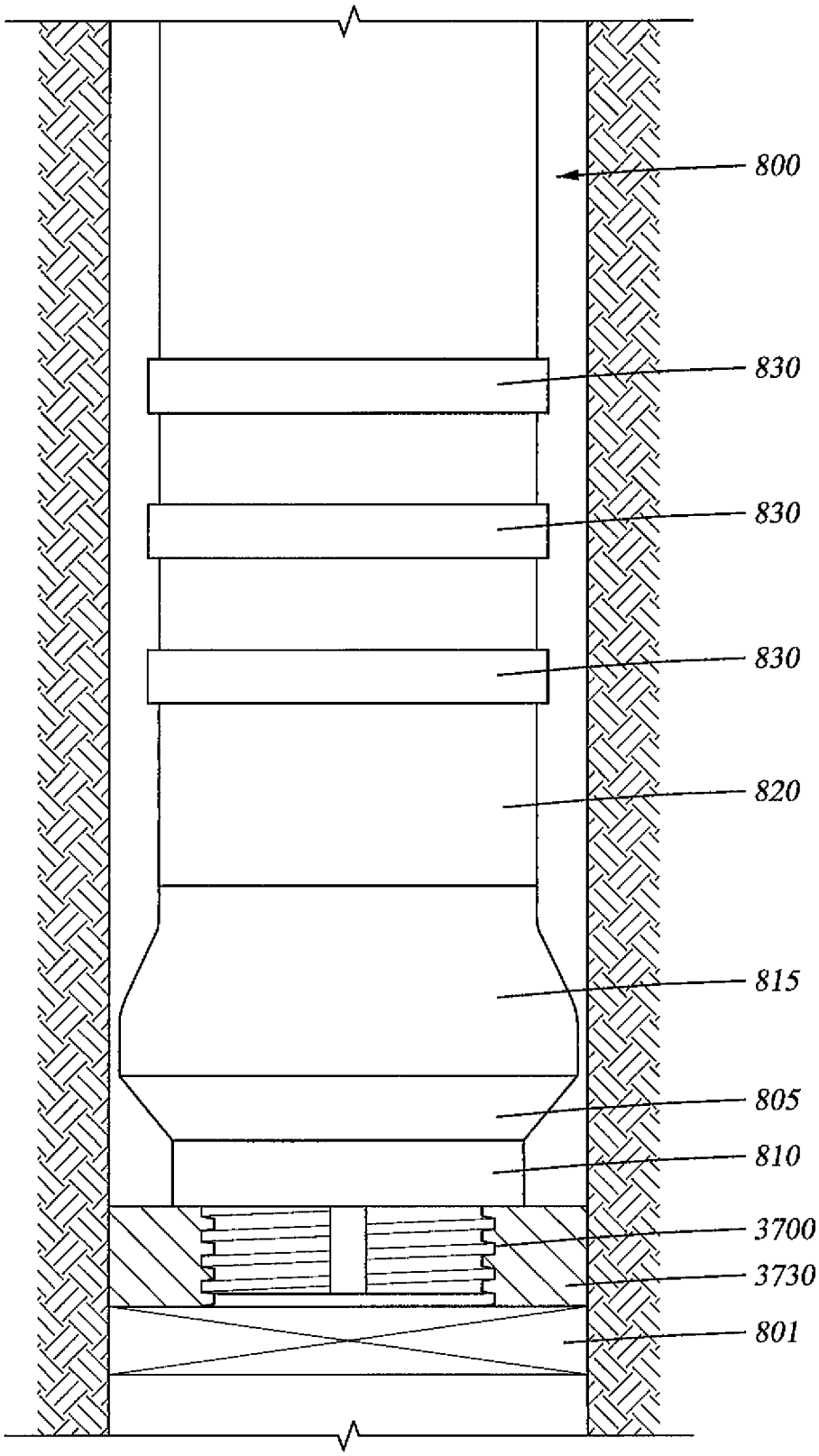
FIG. 8C is a schematic illustration of an expansion system using the coupling of the male threaded connection of FIG. 8A and the female threaded connection of FIG. 8B in accordance with one aspect of the claimed subject matter.

Referring now to FIGS. 8A, 8B, and 8C, a releasable latching mechanism is illustrated. The latching device is a male threaded connector 3700 having a plurality of threads 3710. The threads 3710 may be any threads known in the art, such as for example, Acme, square, ISO metric, and the like. In one embodiment, the threads 3710 are Acme threads. A plurality of perpendicular channels 3720 may be machined into the threads 3710 of the male connection 3700, allowing the male connection 3700 to be press fit into a corresponding female threaded connector 3730. In certain embodiments at least one channel 3720 is present per quarter of the male threaded connector 3720. Thus, at least four perpendicular channels 3720 are machined into the male threaded connector 3700. In certain embodiments, a plurality of channels 3750 may be machined into the threads 3740 of the female connection 3730. The machined perpendicular channels make the connection flexible to allow the user to snap or press fit the male connector 3700 into place, eliminating the need for the male 3700 and female 3730 connectors to be continually rotated relative to one another to engage the threads. In certain embodiments, it may be necessary to rotate the male threaded connector 3700 relative to the female threaded connector 3730 a one-quarter to one-half turn to completely tighten the connection. To release the connection, the male threaded connector 3700 can be rotated approximately a one-quarter to one-half turn and extracted from the corresponding female threaded connector 3730. In certain embodiments, the connection deforms the metal of the threads of the male 3700 and/or the female 3730 connections. In certain other embodiments, the connection is suitable for a one-time use. In certain other embodiments, the connection may be used multiple times before the metal threads are deformed.

In FIG. 8C, an expansion system 800 using the latching mechanism of FIGS. 8A and 8B is shown. Before running the expansion system 800 into the wellbore, a packer 801 is set in the wellbore. The packer 801 may be any packer known in the art, such as a sump packer. The packer 801 may be run into the well and set using, for example, wireline or coiled tubing. The packer 801 includes the female threaded connector 3730, which mates with the male threaded connector 3700 on a shoe 810 at the end of the expansion system 800. After setting the packer 801, the expansion system 800 can be run into the well on a work string (not shown). The expansion system 800 includes an expandable tubular 820, a launcher portion 815, and a shoe 810. Sealing and/or gripping elements 830 are included on the exterior of the expandable tubular 820. To avoid hanging up inside the wellbore, there is a transition nose 805 between the launcher portion 815 and the shoe 810. The expansion device (not shown) is housed inside the launcher portion 815 and attached to the end of the work string.

To anchor the expansion system 800 before expansion, the expansion system 800 is run down into the wellbore until the male threaded connector 3700 inserts into the female threaded connector 3730. The weight of the expansion system 800 and the work string is sufficient to lock the shoe 810 into the packer 801. After anchoring, the work string is pulled upward to force the expansion device upwards out of the launcher portion 815 to expand the rest of the expandable tubular 820. For lubrication and some fluid pressure assistance, fluid may be pumped through the work string while pulling upward.

Figure 9:
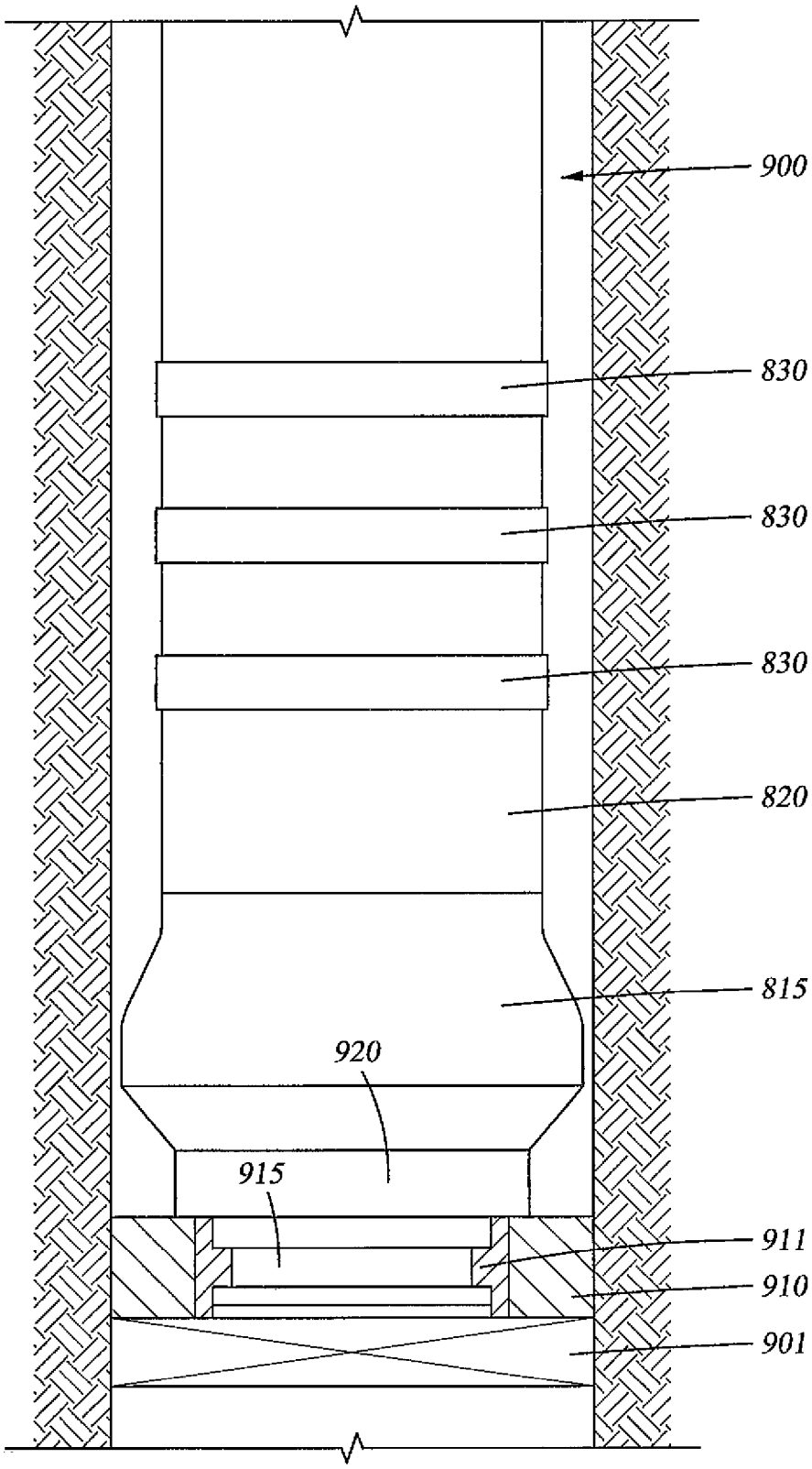
FIG. 9 is a schematic illustration of an expansion system in accordance with one aspect of the claimed subject matter.

Turning to FIG. 9, another expansion system 900 is shown. The expansion system 900 is similar to the expansion system 800 shown in FIG. 8C, except that a different latching mechanism is used. In this embodiment, a collet-type latching mechanism is used to anchor the expansion system 900 to a packer 901. The packer 901 includes a receiver portion 910, which has a shoulder 911. The end of the expansion system 900 includes a shoe 920 below the launcher portion 815. The shoe 920 includes a latching groove 915 to receive the shoulder 911 of the receiver portion 910. One or both of the shoulder 911 and the latching groove 915 is made to be flexible to allow insertion of the shoe 920 into the receiver portion 910. For flexibility, the receiver portion 910 or the shoe 920 may be slotted. Variations of the latching mechanisms shown in FIGS. 2A, 3A, 4A, and 5A may be used to provide flexibility for insertion while providing an anchor for the expansion system 900. In one embodiment, the weight of the expansion system 900 and the work string is sufficient to insert the shoe 920 into the receiver portion 910. After anchoring, the work string is pulled upward to force the expansion device upwards out of the launcher portion 815 to expand the rest of the expandable tubular 820. For lubrication and some fluid pressure assistance, fluid may be pumped through the work string while pulling upward.

Figure 10:
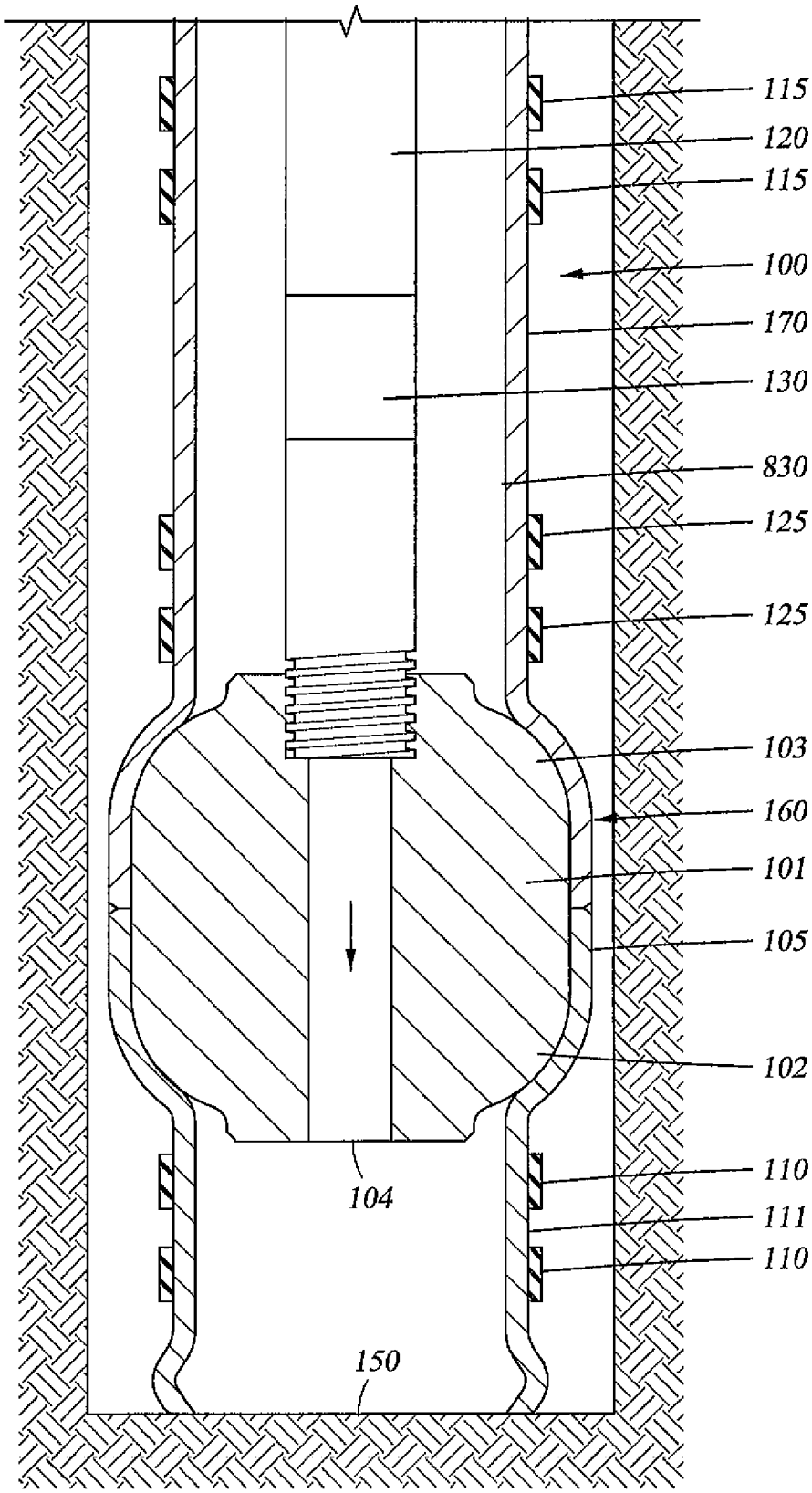
FIG. 10 is a schematic illustration of an expansion system in accordance with one aspect of the claimed subject matter.

In FIG. 10, an expansion system 100 is shown. The expansion system 100 includes a bi-directional cone 101 as the expansion device. The bi-directional cone 101 includes an upper expansion surface 103 and a lower expansion surface 102. A flow bore 104 in the bi-directional cone 101 provides a path for fluid pumped through a work string 120 to pass below the bi-directional cone 101. For placement into the well, the bi-directional cone 101 is contained in a launcher portion 105 attached to the lower end of an expandable tubular 170. The launcher portion 105 may be made integral to the expandable tubular 170 by pre-forming an end of the expandable tubular 170. Alternatively, the launcher portion 105 may be connected to the expandable tubular by, for example, a threaded connection or welding. Below the launcher portion 105, at least one sealing and/or gripping band 110 is disposed in a recessed area 111 to protect it from damage while placing the expansion system 100 into the well. Band 110 may be, for example, an elastomer, swellable elastomer, ductile metal, or other material suitable for sealing between the expandable tubular 170 and wellbore 160. In one embodiment, one band 110 may be primarily for sealing and another member 110 may be primarily for gripping the wellbore 160. The end of the expandable tubular 170, below members 110, may open, as shown in FIG. 10. In another embodiment, the expansion system 100 may include a bull nose assembly or a shoe with a ball valve at the end of the expansion system 100.

To expand the expandable tubular 170, the expansion system 100 is run into the well until contacting a solid bottom capable of supporting enough downward force to expand the portion of the expandable tubular 170 below the launcher portion 105. The "solid bottom" may be, for example, the well bottom 150, a packer, a bridge plug, or any other object capable of supporting a downward load from the expansion system 100. The necessary strength will depend on the size and wall thickness of the expandable tubular 170. In the present example, the solid bottom is the well bottom 150. After making positive contact with the well bottom 150, the weight of the work string 120 is allowed to act against the bi-directional cone 101 to expand the portion of the expandable tubular 170 below the launcher portion 105. Heavy weight drill pipe and/or drill collars may be provided in the work string 120 near the bi-directional cone 101 to provide additional weight for downward expansion. In one embodiment, the work string 120 includes a bumper sub 130, which allows for repeated downward hammering of the bi-directional cone 101 using the weight of the work string 120. During the downward expansion, fluid flow through the work string 120 should be minimized because the force from the fluid acts against the downward movement of the bi-directional cone 101. As the lower expansion surface 102 contacts the inside of recessed area 111, the bands 110 are forced outward into contact with the wellbore 160. The contact force between the bands 110 and the wellbore 160 provides an anchor for the later upward expansion of the expandable tubular 170. The bands 110 may also provide a seal between the expandable tubular 170 and the wellbore 160.

The downward expansion is complete once the bi-directional cone 101 bottoms out, i.e. the work string 120 cannot move lower. The completion of the downward expansion can be verified by pulling up on the work string 120 to see if the resistance to upward pulling is greater than the weight and friction before downward expansion. Because the next step is upward expansion, the verification step may be considered unnecessary. Upward expansion is accomplished by pulling up the work string 120 with sufficient force for the upper expansion surface 103 of the bi-directional cone 101 to expand the expandable tubular 170 above the launcher portion 105. Those having ordinary skill in the art will appreciate that the necessary upward force varies based on the wall thickness and the starting and finishing diameters of the expandable tubular 170, in addition to friction and the geometry of the bi-directional cone 101. The work string 120 may be pulled upward using the surface equipment of the drilling rig. In one embodiment, a hydraulic jack (not shown) in the work string may be used to provide the upward force. An example of a hydraulic jack is disclosed in U.S. Pat. No. 7,383,889, which is incorporated herein by reference in its entirety. In addition to mechanical pulling, the upward expansion process may be assisted by pumping fluid through the work string 120 into the expandable tubular 170 below the bi-directional cone 101, which also provides lubrication for the expansion process. If at some point the upward expansion becomes more difficult, the optional bumper sub 130 may be used to provide a hammering force by successively slacking off and pulling upward on the work string 120 to get past any difficult areas, such as dog legs or other wellbore restrictions. As the upward expansion continues, additional bands 125 may be brought into sealing contact with the wellbore 125. At the top of the expandable tubular 170, bands 115 may be provided to complete the seal between the wellbore 125 and the expandable tubular 170.

The embodiments shown in FIGS. 8C, 9, and 10 provide a simplified mechanical expansion process. In short, the method of using the disclosed expansion system may be as simple as setting down to anchor, then pulling up to expand the expandable tubular. In the embodiments of FIGS. 8C and 9, a prior step of setting a packer or other anchor with the necessary latching feature is performed before running the expansion system into the well, but that can be accomplished relatively quickly with wireline or coiled tubing. In the embodiment shown in FIG. 10, the entire expansion process may be completed in a single trip if the bottom of the well is used as the solid bottom for the downward expansion step.

Although this detailed description has shown and described illustrative embodiments of the invention, this description contemplates a wide range of modifications, changes, and substitutions. In some instances, one may employ some features of the present invention without a corresponding use of the other features. Accordingly, it is appropriate that readers should construe the appended claims broadly, and in a manner consistent with the scope of the invention.

What is claimed is:

1. A system for expanding a tubular member in a wellbore, comprising:

an expandable tubular member comprising a launcher portion near a lower end of the expandable tubular member;

an expansion cone disposed in the launcher portion, wherein the expansion cone comprises an upper expansion surface having a greater outside diameter than an inside diameter of a portion of the expandable tubular member above the launcher portion;

a work string mechanically coupled to the expansion cone, wherein the work string applies a downward force to the expansion cone; and an anchoring portion disposed below and connected to the launcher portion, wherein the anchoring portion is configured to anchor the expandable tubular member in the wellbore prior to upward expansion by radially expanding in response to downward force delivered through the work string to the expansion cone.

2. The system of claim 1, wherein the expansion cone comprises a lower expansion surface having a greater outside diameter than an inside diameter the anchoring portion.

3. The system of claim 2, wherein the anchoring portion comprises at least one band located on an outer surface.

4. The system of claim 3, wherein the at least one band comprises at least one of an elastomer, a swellable elastomer, and a ductile metal.

5. The system of claim 1, wherein the anchoring portion comprises a connector configured to be locked axially into a corresponding connector disposed in the wellbore.

6. The system of claim 5, wherein the connector is a threaded connection having slots formed therein.

7. The system of claim 5, wherein the connector is a collet.

8. A method for expanding a tubular member in a wellbore, comprising:

mechanically applying a downward force to an expansion cone through a work string to anchor the tubular member in the wellbore, wherein the expansion cone is disposed in a launcher portion connected to the tubular member being expanded, and wherein the downward force radially expands an anchoring portion disposed below and connected to the launcher portion;

after applying the downward force, pulling upwards on the expansion cone with the work string to expand the tubular member.

9. The method of claim 8, wherein the downward force applied to the expansion cone is less than the weight of the work string.

10. The method of claim 8, further comprising:

pumping fluid through the expansion cone while pulling upwards on the expansion cone with the work string.

11. The method of claim 8, wherein the expansion cone is bi-directional.

12. The method of claim 11, wherein the work string comprises a bumper sub and the downward force is applied repeatedly to expand the anchor portion.

13. The method of claim 8, wherein the anchoring is provided by inserting a connector portion disposed below the launcher portion into a corresponding connector previously disposed in the wellbore.

14. The method of claim 13, wherein the corresponding connector is attached to a packer.

* * * * *